US011525609B2

(12) United States Patent
Oh et al.

(10) Patent No.: US 11,525,609 B2
(45) Date of Patent: Dec. 13, 2022

(54) ENTRANCE REFRIGERATOR

(71) Applicant: LG ELECTRONICS INC., Seoul (KR)

(72) Inventors: Minkyu Oh, Seoul (KR); Minseok Kim, Seoul (KR); Insun Yeo, Seoul (KR); Deukwon Lee, Seoul (KR); Wonjin Lee, Seoul (KR); Kyukwan Choi, Seoul (KR); Yezo Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 357 days.

(21) Appl. No.: 16/798,778

(22) Filed: Feb. 24, 2020

(65) Prior Publication Data

US 2020/0271358 A1 Aug. 27, 2020

(30) Foreign Application Priority Data

Feb. 25, 2019 (KR) ..... 10-2019-0021867
Jul. 18, 2019 (KR) ..... 10-2019-0086973

(51) Int. Cl.
*F25B 21/02* (2006.01)
*F25D 11/02* (2006.01)
(Continued)

(52) U.S. Cl.
CPC ..... *F25B 21/02* (2013.01); *F25D 11/02* (2013.01); *F25D 17/062* (2013.01);
(Continued)

(58) Field of Classification Search
CPC .. F25B 2321/0251; F25B 21/02; F25D 23/10; F25D 17/08
See application file for complete search history.

(56) References Cited

U.S. PATENT DOCUMENTS 3,078,682 A 2/1963 Gould
3,177,678 A 4/1965 Facey, Jr.
(Continued)

FOREIGN PATENT DOCUMENTS

CA 2461635 A1 9/2005
CN 2165389 Y 5/1994
(Continued)

OTHER PUBLICATIONS

U.S. Office Action for U.S. Appl. No. 16/798,962, dated Oct. 21, 2021.
(Continued)

*Primary Examiner* — Ana M Vazquez
(74) *Attorney, Agent, or Firm* — Birch, Stewart, Kolasch & Birch, LLP

(57) ABSTRACT

An entrance refrigerator includes a cabinet installed to pass through a front door or a wall and forming a storage compartment for storing goods, a housing coupled to a lower end of the cabinet, an outdoor side door coupled to a front surface of the cabinet to open or close the storage compartment and exposed to an outside, an indoor side door coupled to a rear surface of the cabinet to open or close the storage compartment and exposed to an inside, a cold air supply device accommodated in a space defined by a lower portion of the cabinet and the housing and supplying cold air to the storage compartment, and at least one guide duct mounted on a bottom surface of the housing and extending in a front-to-rear direction of the housing, the at least one guide duct having a discharge port formed therein.

18 Claims, 19 Drawing Sheets

(51) Int. Cl.

| | |
|---|---|
| ***F25D 23/02*** | (2006.01) |
| ***F25D 17/06*** | (2006.01) |
| ***F25D 25/00*** | (2006.01) |
| ***F25D 31/00*** | (2006.01) |

(52) U.S. Cl.
CPC ..... *F25D 23/028* (2013.01); *F25D 25/00* (2013.01); *F25D 31/005* (2013.01)

(56) References Cited

U.S. PATENT DOCUMENTS

| | | | | |
|---|---|---|---|---|
| 3,823,567 | A | 7/1974 | Corini | |
| 4,726,193 | A | 2/1988 | Burke et al. | |
| 4,738,113 | A | 4/1988 | Rudick | |
| 5,315,830 | A | 5/1994 | Doke et al. | |
| 5,774,053 | A | 6/1998 | Porter | |
| 7,308,796 | B1 | 12/2007 | Eager | |
| 7,934,384 | B2 * | 5/2011 | Tuskiewicz ..... | F25D 29/00 62/3.2 |
| 2003/0084670 | A1 | 5/2003 | Kim et al. | |
| 2004/0210153 | A1 | 10/2004 | Tsukashima et al. | |
| 2005/0122682 | A1 | 6/2005 | Streit et al. | |
| 2005/0210884 | A1 | 9/2005 | Tuskiewicz et al. | |
| 2010/0043472 | A1 | 2/2010 | Iguchi et al. | |
| 2017/0213187 | A1 | 7/2017 | Choi et al. | |
| 2017/0251833 | A1 | 9/2017 | Stolarz et al. | |
| 2018/0087822 | A1 | 3/2018 | Han et al. | |
| 2018/0087824 | A1 | 3/2018 | Han et al. | |
| 2018/0187944 | A1 | 7/2018 | Park et al. | |
| 2018/0274825 | A1 | 9/2018 | Choi et al. | |
| 2018/0283765 | A1 | 10/2018 | Yi et al. | |
| 2019/0033897 | A1 | 1/2019 | Barbier | |
| 2019/0231106 | A1 | 8/2019 | Kaiserman et al. | |

FOREIGN PATENT DOCUMENTS

| | | | |
|---|---|---|---|
| CN | 2387485 | Y | 7/2000 |
| CN | 1727820 | A | 2/2006 |
| CN | 101210760 | A | 7/2008 |
| CN | 201277783 | Y | 7/2009 |
| CN | 102589236 | A | 7/2012 |
| CN | 102809259 | A | 12/2012 |
| CN | 102914119 | A | 2/2013 |
| CN | 102927748 | A | 2/2013 |
| CN | 203534032 | U | 4/2014 |
| CN | 204923627 | U | 12/2015 |
| CN | 105389944 | A | 3/2016 |
| CN | 206257869 | U | 6/2017 |
| CN | 206362072 | U | 7/2017 |
| CN | 107084583 | A | 8/2017 |
| CN | 107440482 | A | 12/2017 |
| CN | 207006712 | U | 2/2018 |
| CN | 108344233 | A | 7/2018 |
| CN | 108458540 | A | 8/2018 |
| CN | 108471893 | A | 8/2018 |
| CN | 207922675 | U | 9/2018 |
| CN | 207922676 | U | 9/2018 |
| CN | 108882798 | A | 11/2018 |
| CN | 108917256 | A | 11/2018 |
| EP | 0902686 | | 6/1999 |
| EP | 1004487 | B1 | 6/2005 |
| EP | 2980511 | A1 | 2/2016 |
| FR | 1347414 | A | 12/1963 |
| JP | 5-149675 | A | 6/1993 |
| JP | 10-267501 | A | 10/1998 |
| JP | 11-94423 | A | 4/1999 |
| JP | 2017-198360 | A | 11/2017 |
| KR | 10-2011-0033394 | A | 3/2011 |
| KR | 10-2014-0039467 | A | 4/2014 |
| TW | 499559 | B | 8/2002 |
| WO | WO 97/41542 | A1 | 11/1997 |
| WO | WO 2006/087690 | A2 | 8/2006 |

OTHER PUBLICATIONS

U.S. Notice of Allowance for U.S. Appl. No. 16/798,683, dated May 10, 2022.
U.S. Office Action dated Apr. 4, 2022 for U.S. Appl. No. 16/796,617.
U.S. Office Action for U.S. Appl. No. 16/798,600, dated Sep. 6, 2022.

* cited by examiner

ENTRANCE REFRIGERATOR

CROSS-REFERENCE TO RELATED APPLICATIONS

The present application claims the benefits of priority to Korean Patent Application No. 10-2019-0021867, filed on Feb. 25, 2019, and Korean Patent Application No. 10-2019-0086973, filed on Jul. 18, 2019, all of which are herein incorporated by reference in their entireties.

BACKGROUND

The present disclosure relates to a refrigerator installed at an entrance of a building, such as a home or a business.

Recently, delivery services for delivering fresh goods to predetermined places are being utilized. In particular, when the goods are fresh food, a delivery vehicle is provided with a refrigerator or a warmer to store and deliver the food so as to prevent the food from spoiling or cooling.

Generally, the food is packed in a packaging material and delivered so as to keep the food cool or warm, depending on the type of food. The packaging material is often composed of environmental pollutants such as polystyrene foam. The social atmosphere recently has placed an emphasis on a reduction of an amount of packaging material used.

When a user is at home at the time of a delivery, the delivery person may deliver the food to the user in a face-to-face manner. However, when the user is not at home or when the delivery time is too early or too late, it is difficult for the delivery person to deliver the food in a face-to-face manner.

Therefore, there is a need to be able to deliver the food even if the delivery person does not face the user, and to prevent the food from spoiling or cooling until the food is finally delivered to the user.

To solve this problem, in recent years, a product has been introduced in which a refrigerator is installed at an entrance (e.g. a front door or entrance door) of a predetermined place, so that a delivery person can deliver the food into the refrigerator in order to keep the food fresh until a user can receive the food by accessing the refrigerator at a convenient time.

SUMMARY

An aspect of the present disclosure provides an entrance refrigerator in which relatively high temperature air forcibly flowing due to a heat dissipation fan of a cold air supply device does not come into direct contact with a user.

According to one embodiment, an entrance refrigerator includes a cabinet configured to pass through a front door or a wall and forming a storage compartment for storing goods, a housing coupled to a lower end of the cabinet, an outdoor side door coupled to a front surface of the cabinet to open or close the storage compartment and exposed to an outside, an indoor side door coupled to a rear surface of the cabinet to open or close the storage compartment and exposed to an inside, a cold air supply device accommodated in a space defined by a lower portion of the cabinet and the housing and configured to supply cold air to the storage compartment, and at least one guide duct mounted on a bottom surface of the housing and extending in a front-to-rear direction of the housing, the at least one guide duct having a discharge port formed therein.

The entrance refrigerator configured as described above according to the embodiment has the following effects.

When the indoor air introduced into the housing by the heat dissipation fan is discharged back to the room after the temperature of the air has increased due to exchanging heat with the heat sink, the air moves downward along the rear surface of the front door or wall on which the entrance refrigerator is mounted. Therefore, the heat of the discharged air does not directly touch the user's body.

In addition, even if the indoor air suctioned into the housing is discharged at a high temperature by heat exchange with the heat sink, the temperature of the discharged air is lowered through heat exchange with the front door or wall as the discharged air moves downward along the rear surface of the front door or wall.

The details of one or more embodiments are set forth in the accompanying drawings and the description below. Other features will be apparent from the description and drawings, and from the claims.

DETAILED DESCRIPTION OF THE EMBODIMENTS

Hereinafter, an entrance refrigerator 10 according to an embodiment will be described in detail with reference to the accompanying drawings.

Figure 1:
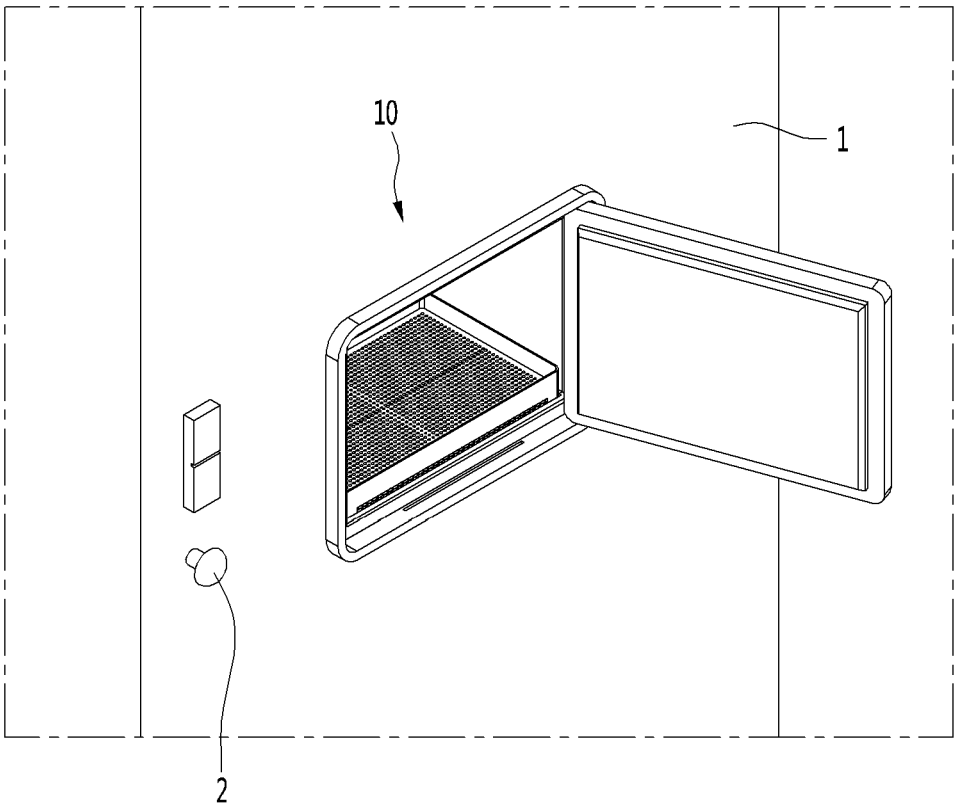
FIG. 1 is a front view of an entrance refrigerator installed at a front door, according to an embodiment.
Figure 2:
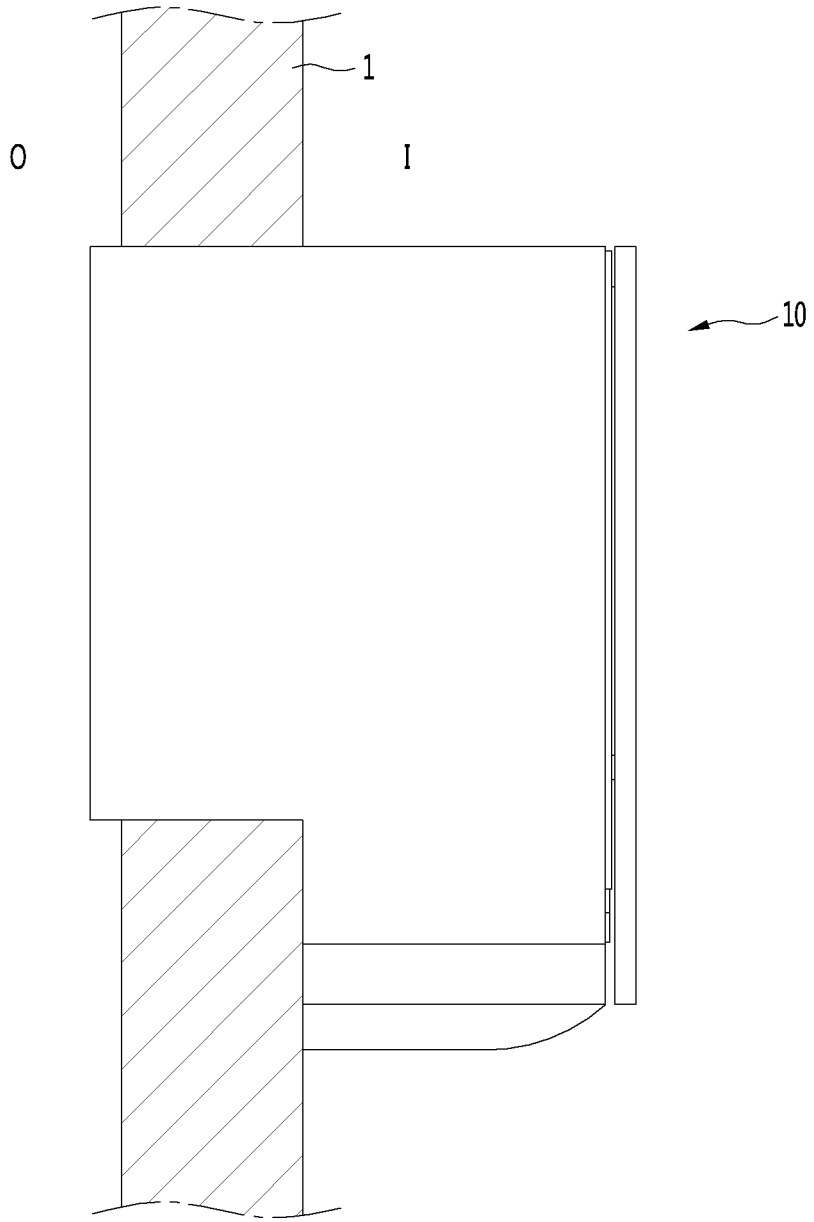
FIG. 2 is a side view of the entrance refrigerator installed at the front door, according to an embodiment.

FIG. 1 is a front view of an entrance refrigerator 10 according to an embodiment installed at a front door of a building, such as a residence, and FIG. 2 is a side view of the entrance refrigerator 10 installed at the front door, according to an embodiment.

Referring to FIGS. 1 and 2, the entrance refrigerator 10 according to the embodiment may be mounted by passing through a suitably-sized opening in a front door 1 or a front wall of a house.

In detail, the entrance refrigerator 10 may be mounted at a point spaced apart from a knob 2 of the front door 1, for example, the entrance refrigerator 10 may be mounted at the center of the front door 1.

In addition, the entrance refrigerator 10 is preferably installed at a height within two meters from the bottom of the front door 1 for convenience of a user and for convenience to a delivery person who delivers goods to the entrance refrigerator 10. Preferably, the entrance refrigerator 10 may be installed at a height in a range of 1.5 meters to 1.7 meters from the bottom of the front door 1.

One portion of the entrance refrigerator 10 is exposed to the outside O (outdoors), and another portion of the entrance refrigerator 10 is exposed to the inside I (indoors). For example, in the entrance refrigerator 10, the surface exposed to the outside O may be defined as the front surface (or outdoor portion) at the front side (exterior side) of the door or wall, and the surface exposed to the inside I may be defined as the rear surface (or indoor portion) at the rear side (interior side) of the door or wall. The door or wall provides a barrier in or around a building, such as, but not limited to, a house, apartment, office, hospital, or the like.

Hereinafter, the configuration of the entrance refrigerator 10 according to the embodiment will be described in more detail with reference to the accompanying drawings.

Figure 3:
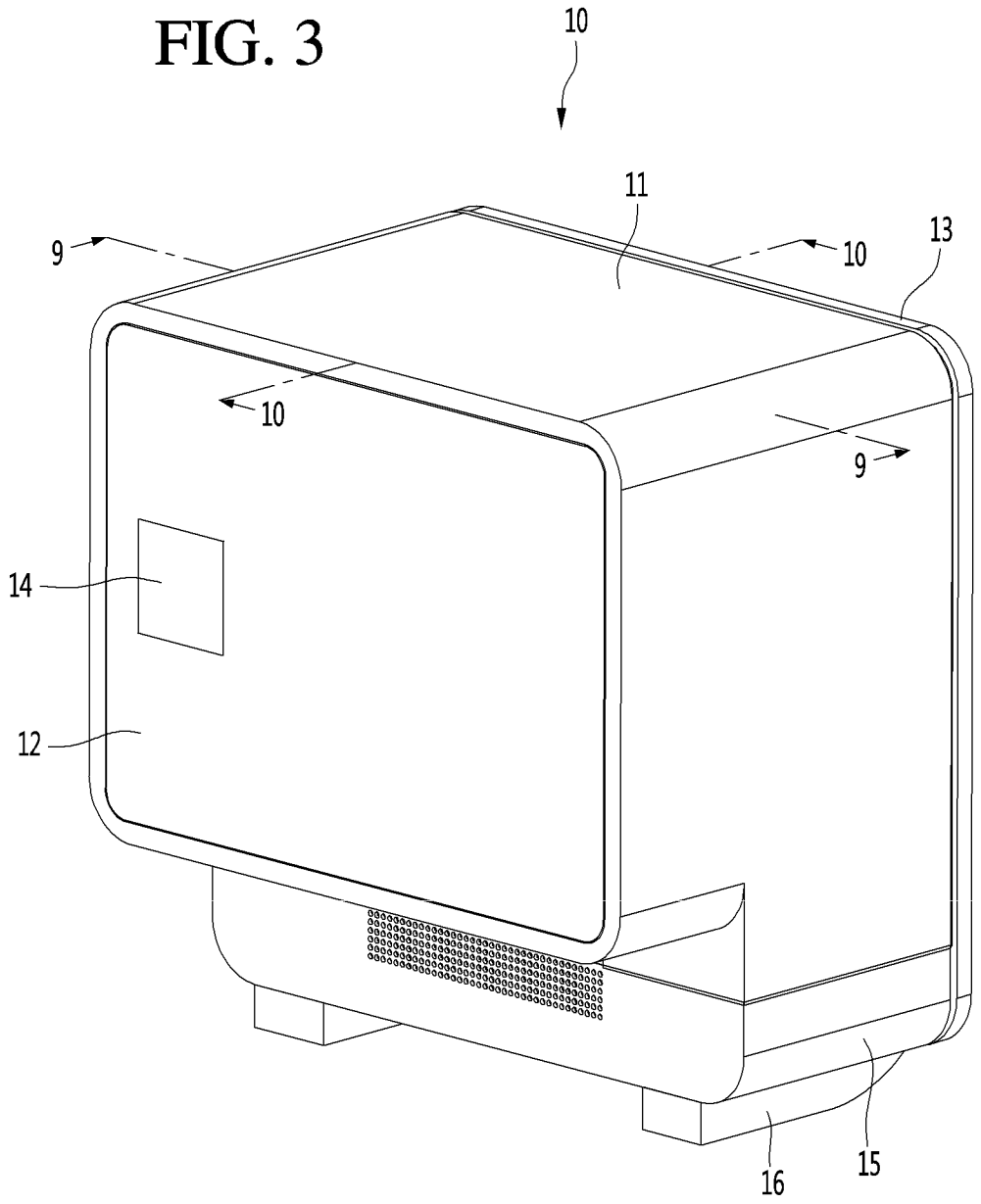
FIG. 3 is a front perspective view of the entrance refrigerator according to an embodiment.
Figure 4:
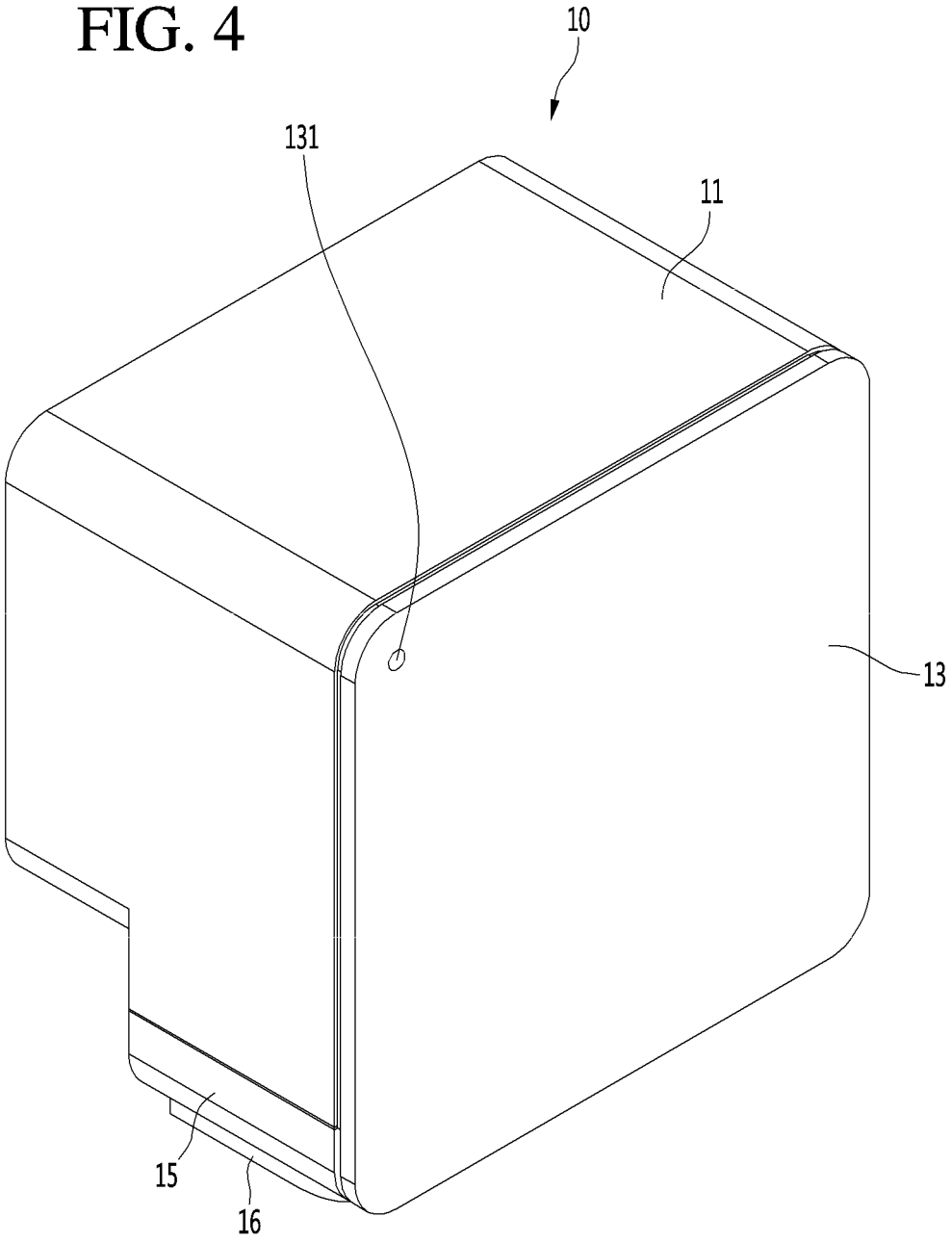
FIG. 4 is a rear perspective view of the entrance refrigerator according to an embodiment.
Figure 5:
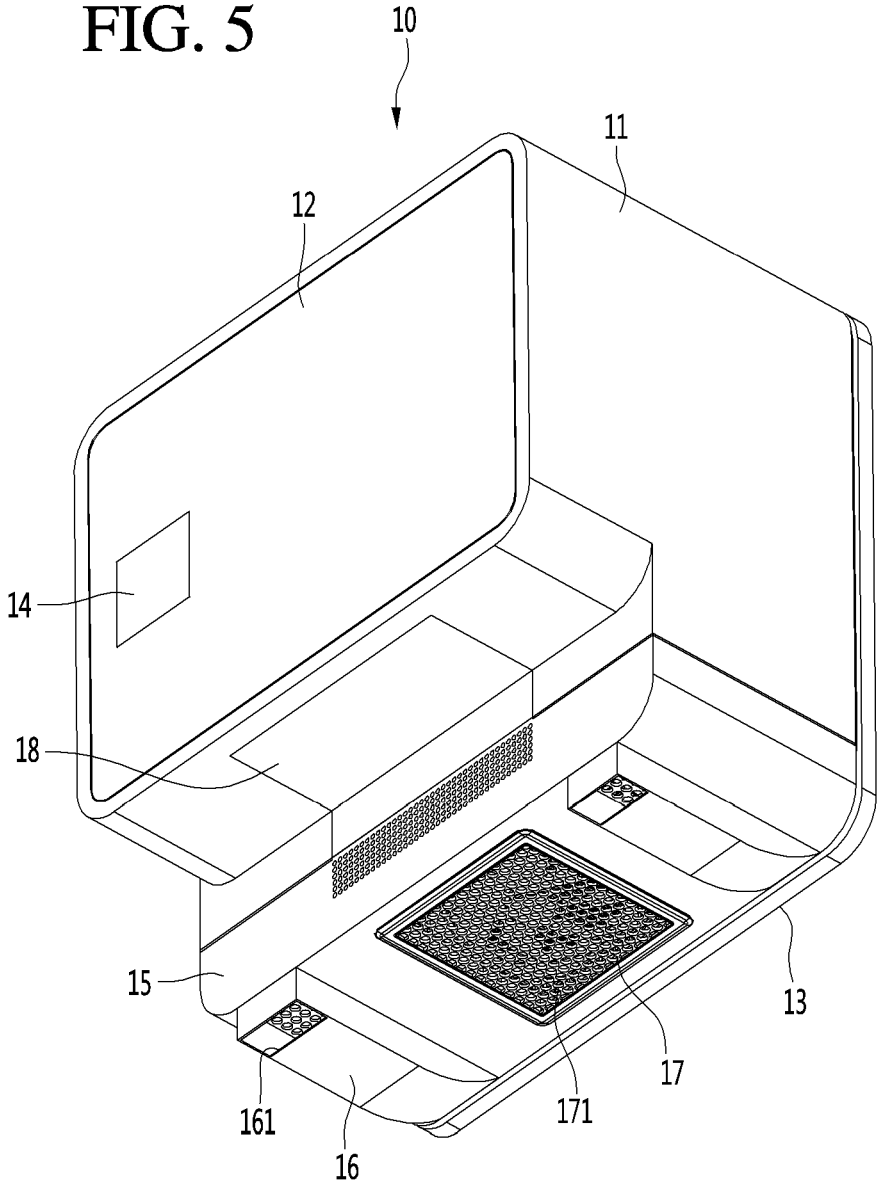
FIG. 5 is a bottom perspective view of the entrance refrigerator according to an embodiment.

FIG. 3 is a front perspective view of the entrance refrigerator 10 according to an embodiment, FIG. 4 is a rear perspective view of the entrance refrigerator 10, and FIG. 5 is a bottom perspective view of the entrance refrigerator 10.

Referring to FIGS. 3 to 5, the entrance refrigerator 10 according to the embodiment may include a cabinet 11, an outdoor side door 12, an indoor side door 13, and a housing 15.

The cabinet 11 has a front opening provided in a portion of the cabinet 11 located at the front (exterior) side of the door or exterior wall, and a rear opening provided in a portion of the cabinet 11 located at the rear (interior) side of the door or interior wall. The cabinet 11 may have an approximately hexahedral shape with a front wall and a rear wall interconnected by a plurality of side walls. The front opening may be provided in the front wall of the cabinet 11, and the rear opening may be provided in the rear wall of the cabinet 11, although the embodiment is not limited thereto. For example, the front opening and the rear opening may be provided on a same side of the cabinet 11 depending on the location where the entrance refrigerator 10 is being installed. The outdoor side door 12 may be rotatably coupled to the cabinet 11 so as to selectively open or close the front opening of the cabinet 11. The outdoor side door 12 may be opened by the delivery person in order to store goods in the entrance refrigerator 10. In addition, the outdoor side door 12 may be opened by the user so as to withdraw goods from the entrance refrigerator 10.

Here, the term "user" is defined as a person who has ordered goods that are stored in the entrance refrigerator 10 by the delivery person, or as a person having authority to release the goods from the entrance refrigerator 10.

In addition, the indoor side door 13 may be rotatably coupled to the cabinet 11 so as to selectively open or close the rear opening of the cabinet 11.

A display 14 may be provided on the outdoor side door 12. The display 14 may display information about an operating state of the entrance refrigerator 10, an internal temperature of the entrance refrigerator 10, and the presence or absence of goods in the entrance refrigerator 10.

In addition, the delivery person who delivers goods may input a password or the like through the display 14 for opening the outdoor side door 12.

A code scanner for recognizing an encryption code provided in a shipping order or a shipping box may be provided on one side of the outdoor side door 12.

The indoor side door 13 is used by the user within the house to take out goods stored in the entrance refrigerator 10. That is, the user can open the indoor side door 13 to withdraw the goods from the entrance refrigerator 10 and into the house.

A guide light 131 may be provided at one side of the indoor side door 13. The guide light 131 may be a device for informing a user whether or not goods are currently stored in the entrance refrigerator 10. For example, the color of the guide light 131 may be set differently depending on whether goods are stored in the entrance refrigerator 10 or whether the entrance refrigerator 10 is empty. The user may recognize whether there are goods currently being stored even without opening the indoor side door 13.

The housing 15 is provided at the lower end of the cabinet 11, either integrally as part of the cabinet 11 or as a separate element attached to the cabinet 11. A cold air supply device 30 (cold air supplier), to be described later, is accommodated in the housing 15. The front surface of the housing 15 comes into close proximity with the rear surface of the front door 1 or the wall when the entrance refrigerator 10 is mounted on the front door 1 or the wall, and contact between a portion of the front surface of the housing 15 and the rear surface of the front door 1 or the wall cancels the moment due to the eccentric load of the entrance refrigerator 10 within the opening of the front door 1 or the wall.

In detail, the entrance refrigerator 10 according to the embodiment has a structural characteristic in which a volume of a part exposed indoors is larger than a volume of a part exposed outdoors of the front door 1. Therefore, the center of gravity of the entrance refrigerator 10 is formed at a point eccentric rearwardly of the center of the entrance refrigerator 10. As a result, the moment is generated by the load of the entrance refrigerator 10 and the load of goods stored therein. With such an arrangement, it is possible that the entrance refrigerator 10 could be pulled out of the front door 1 by the moment.

However, since the front surface of the housing 15 contacts the rear surface of the front door 1 or the wall, the moment acting on the entrance refrigerator 10 is cancelled, thereby preventing the entrance refrigerator 10 from being separated from the front door 1.

A pair of guide ducts 16 may be provided at left and right edges of the bottom surface of the housing 15. A discharge port 161 is formed at the front end of each guide duct 16 so that indoor air, which flows into the cold air supply device 30 in the housing 15 and performs a heat dissipation function, may be discharged out of the housing 15.

A guide plate 18 may be provided on an angled surface of the cabinet 11 formed by the bottom surface of the cabinet 11 and the front surface of the housing 15. The function of the guide plate 18 will be described below with reference to the accompanying drawings.

An opening for suctioning indoor air may be formed in the bottom surface of the housing 15, and a suction plate 17 may be mounted at the opening. A plurality of through-holes 171 may be formed in the suction plate 17, and indoor air is introduced into the housing 15 through the plurality of through-holes 171. At least part of the indoor air introduced into the housing 15 is discharged back out of the housing 15 through the discharge ports 161 of the guide ducts 16.

Figure 6:
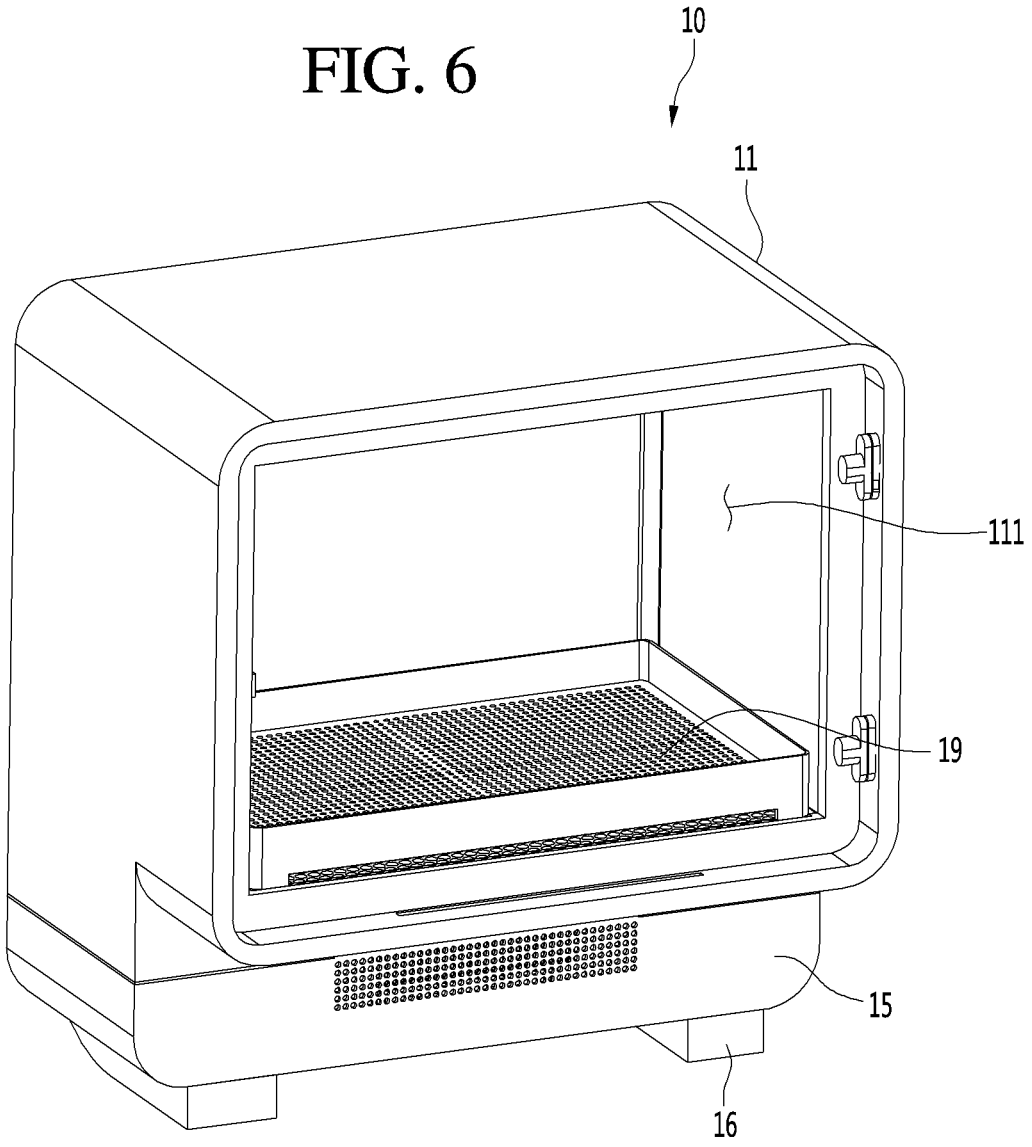
FIG. 6 is a front perspective view of the entrance refrigerator in a state in which an outdoor side door is removed for clarity of illustration, according to an embodiment.
Figure 7:
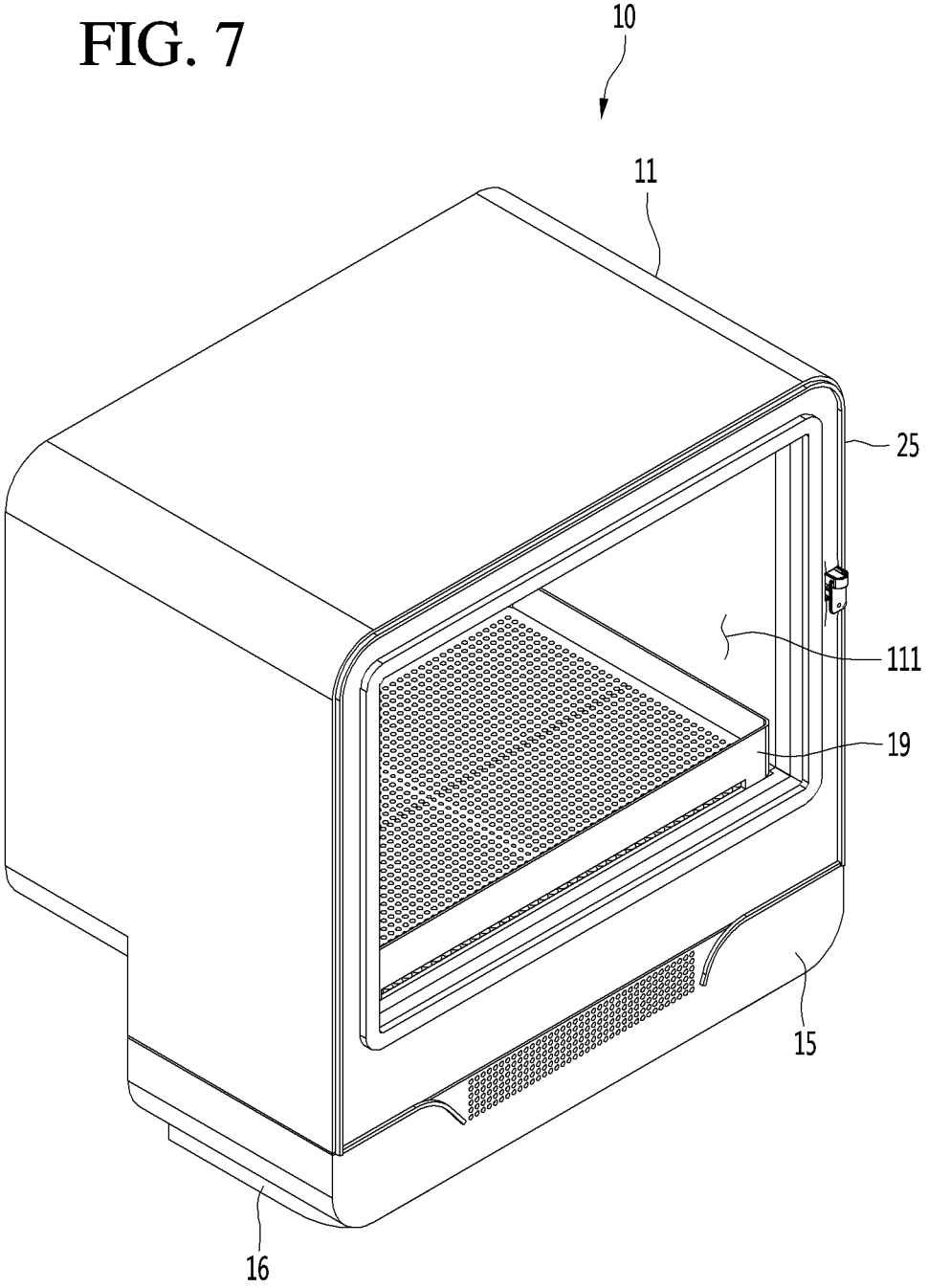
FIG. 7 is a rear perspective view of the entrance refrigerator in a state in which an indoor side door is removed for clarity of illustration, according to an embodiment.

FIG. 6 is a front perspective view of the entrance refrigerator 10 in a state in which the outdoor side door 12 is removed for clarity of illustration, according to an embodiment, and FIG. 7 is a rear perspective view of the entrance refrigerator in a state in which the indoor side door 13 is removed for clarity of illustration, according to an embodiment.

Referring to FIGS. 6 and 7, a storage compartment 111 in which goods may be stored is provided within the cabinet 11. The storage compartment 111 may be considered as a main body of the entrance refrigerator 10 according to the embodiment.

A tray 19 on which goods are placed may be provided at a lower portion of the storage compartment 111.

In addition, a guide rib 25 may be formed along the rear edge of the cabinet 11. The guide rib 25 may protrude a predetermined distance from the rear surface of the cabinet 11 and extend along an edge of the cabinet 11. The guide rib 25 is provided to guide some of the air discharged from the housing 15 upwardly to the area surrounding the indoor side door 13 so that condensation is prevented from forming on a gasket 22 surrounding the rear surface of the indoor side door 13.

Figure 8:
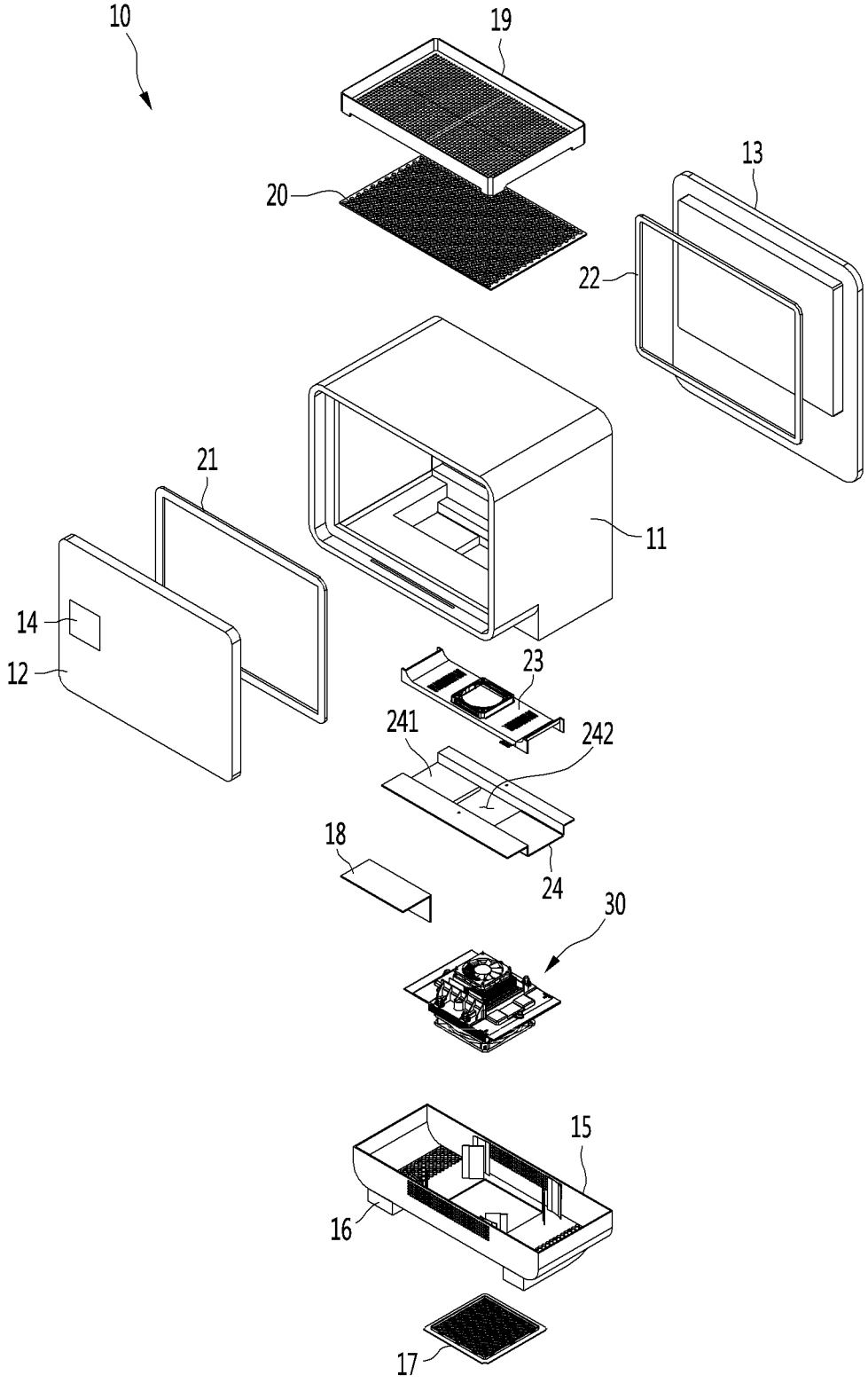
FIG. 8 is an exploded perspective view of the entrance refrigerator according to an embodiment.
Figure 9:
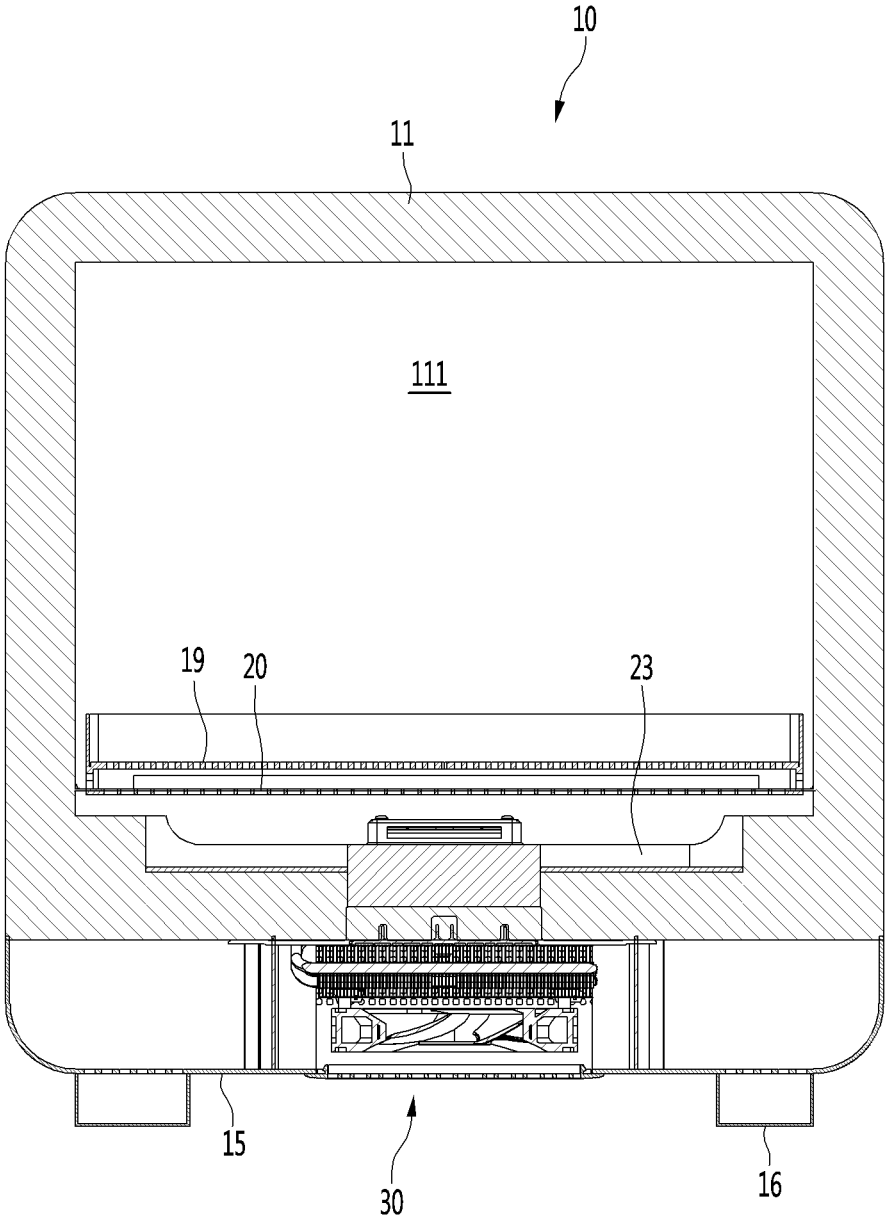
FIG. 9 is a cross-sectional view of the entrance refrigerator, taken along line 9-9 of FIG. 3.
Figure 10:
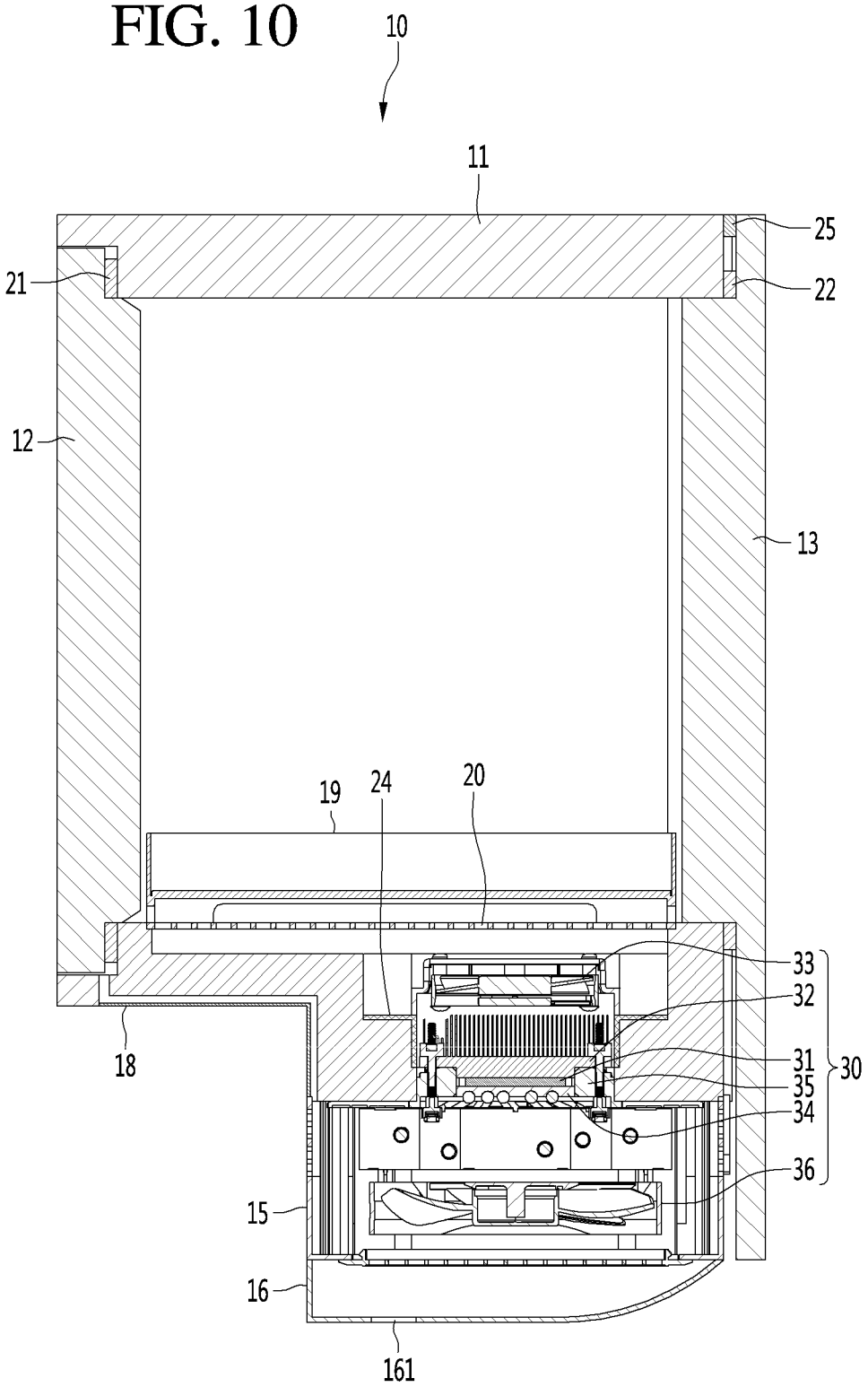
FIG. 10 is a side cross-sectional view of the entrance refrigerator, taken along line 10-10 of FIG. 3.

FIG. 8 is an exploded perspective view of the entrance refrigerator 10 according to an embodiment, FIG. 9 is a cross-sectional view of the entrance refrigerator 10, taken along line 9-9 of FIG. 3, and FIG. 10 is a side cross-sectional view of the entrance refrigerator 10, taken along line 10-10 of FIG. 3.

Referring to FIGS. 8 to 10, as described above, the entrance refrigerator 10 according to the embodiment may include the cabinet 11, the indoor side door 13, the outdoor side door 12, the housing 15, the guide duct 16, the suction plate 17, and the tray 19.

The entrance refrigerator 10 may further include a base plate 20 disposed at the bottom portion of the cabinet 11. The tray 19 may be disposed above the base plate 20. The bottom surface of the tray 19 may be spaced apart upward from the base plate 20.

The entrance refrigerator 10 may further include a cold air supply device 30 accommodated in the housing 15.

The cold air supply device 30 may be a device to which a thermoelectric element (Peltier element) is applied, but the cold air supply device 30 is not limited thereto. For example, a general cooling cycle may be applied to the cold air supply device 30.

When a current is supplied to the thermoelectric element, one surface thereof acts as a heat absorbing surface in which a temperature drops, and the other surface thereof acts as a heat generating surface in which a temperature increases. In addition, when the direction of the current supplied to the thermoelectric element is changed, the heat absorbing surface and the heat generating surface are swapped.

In detail, the cold air supply device 30 may include a thermoelectric element 31, a cold sink 32 attached to the heat absorbing surface of the thermoelectric element 31, a heat absorption fan 33 disposed above the cold sink 32, a heat sink 34 attached to the heat generating surface of the thermoelectric element 31, a heat dissipation fan 36 disposed below the heat sink 34, and an insulation material 35 for preventing heat transfer between the cold sink 32 and the heat sink 34.

The insulation material 35 is provided to surround the side surface of the thermoelectric element 31. The cold sink 32 comes into contact with the upper surface of the insulation material 35, and the heat sink 34 comes into contact with the lower surface of the insulation material 35.

The cold sink 32 and the heat sink 34 may include a thermal conductor directly attached to the heat absorbing surface and the heat generating surface, respectively, of the thermoelectric element 31, and a plurality of heat exchange fins extending from the surface of the thermal conductor.

The heat absorption fan 33 is disposed to face the inside of the cabinet 11, and the heat dissipation fan 36 is disposed directly above the suction plate 17.

The entrance refrigerator 10 may further include a mount plate 24 mounted on the bottom of the cabinet 11, and a flow guide 23 mounted on the upper surface of the mount plate 24.

The mount plate 24 may be formed in a shape in which a rectangular plate is bent a plurality of times to include a bottom portion, a pair of upstanding side portions, and a pair of outwardly extending flange portions. The mount plate 24 may be formed in a shape in which a flow guide seating portion 241, on which the flow guide 23 is seated, is recessed or stepped to a predetermined depth. A through-hole 242 is formed at the bottom portion of the mount plate 24 defining the flow guide seating portion 241. A portion of the cold air supply device 30 may pass through the through-hole 242 and be mounted to the mount plate 24.

In addition, the flow guide 23 may be understood as a device for forming the flow path of the air inside the storage compartment 111 which forcibly flows by the heat absorption fan 33.

The base plate 20 may be disposed above the flow guide 23 to minimize a possibility that foreign substances could fall directly onto the flow guide 23.

An outer gasket 21 is provided on an inner side of the outdoor side door 12 that faces the cabinet 11, and an inner gasket 22 is provided on an inner side of the indoor side door 13 that faces the cabinet 11. The outer gasket 21 and the inner gasket 22 prevent cold air within the storage compartment 111 from leaking to the outside of the entrance refrigerator 10. Alternatively, the outer gasket 21 may be provided on a portion of the cabinet 11 that faces an inner side of the outdoor side door 12, and the inner gasket 22 may be provided on a portion of the cabinet 11 that faces an inner side of the indoor side door 13. The portion of the cabinet 11 may be a contact shoulder 115 to be described later. The outer gasket 21 and the inner gasket 22 prevent cold air within the storage compartment 111 from leaking to the outside of the entrance refrigerator 10.

Figure 11:
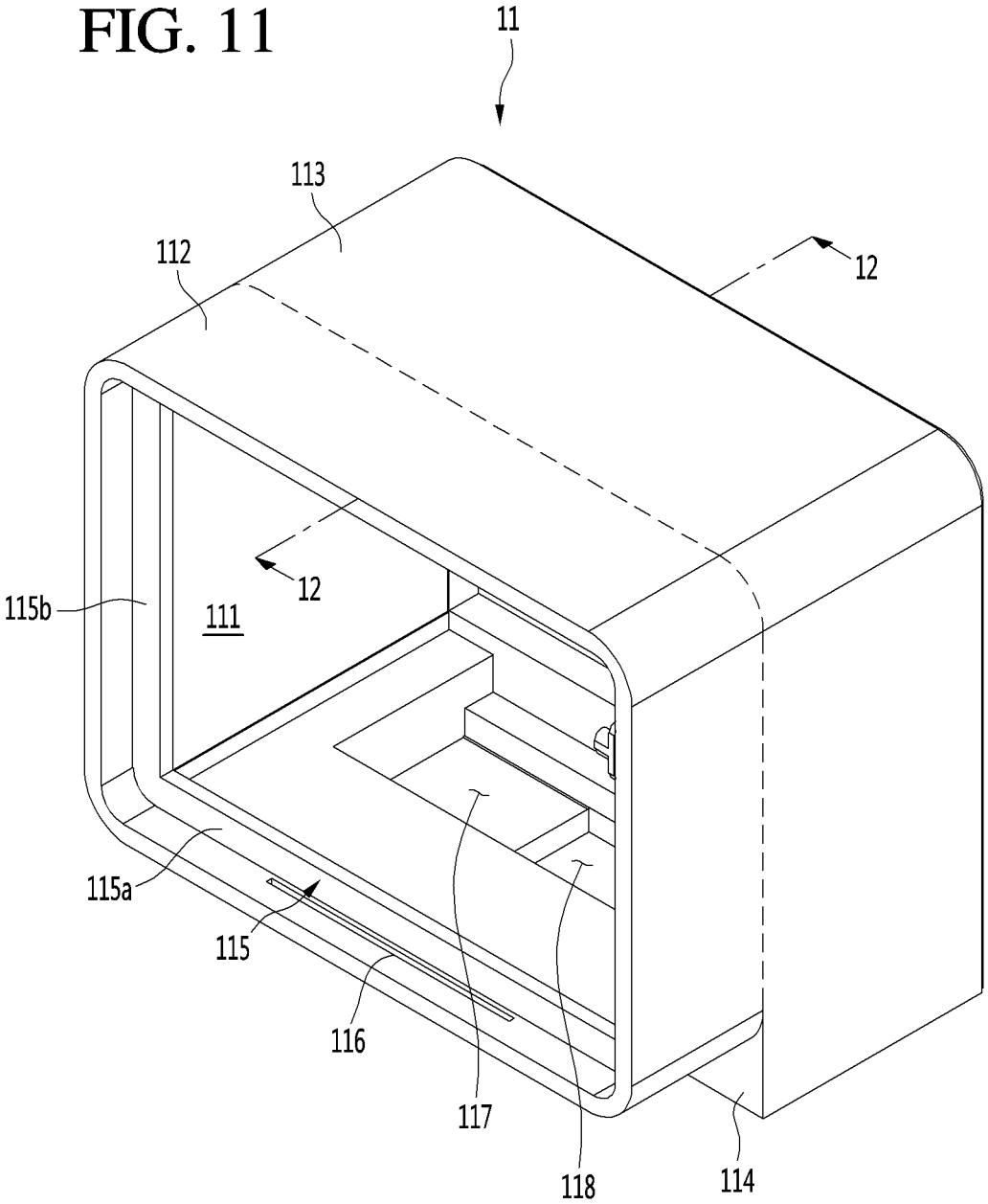
FIG. 11 is a perspective view of a cabinet constituting the entrance refrigerator, according to an embodiment.
Figure 12:
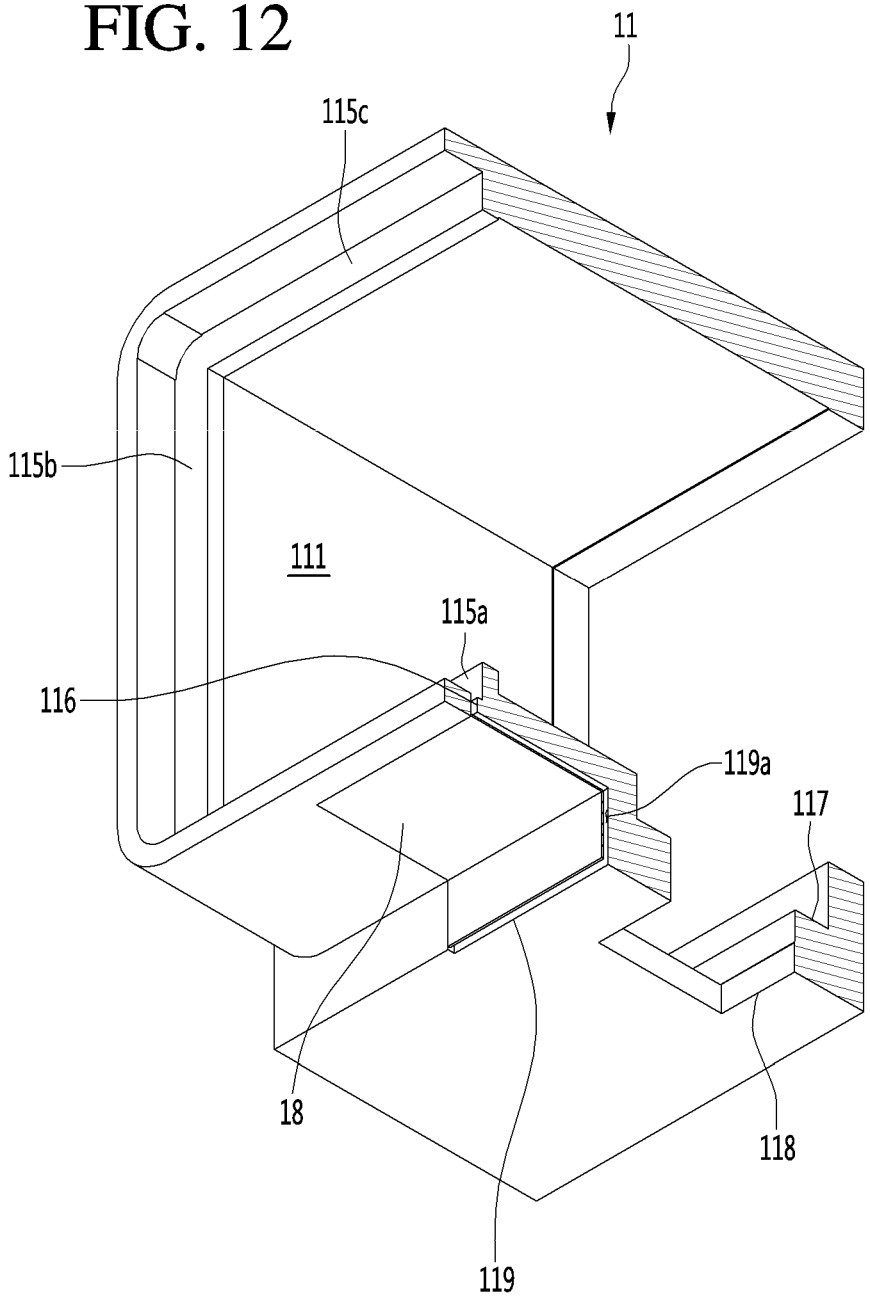
FIG. 12 is a side cross-sectional view taken along line 12-12 of FIG. 11.

FIG. 11 is a perspective view of the cabinet 11 constituting the entrance refrigerator 10, according to an embodiment, and FIG. 12 is a side cross-sectional view taken along line 12-12 of FIG. 11.

Referring to FIGS. 11 and 12, the cabinet 11 constituting the entrance refrigerator 10 according to the embodiment has a hexahedral shape in which the front side and the rear side are opened.

The cabinet 11 may include a first portion 112 (exterior portion) inserted through the front door 1 or the wall, and a second portion 113 (interior portion) exposed to the inside.

The lower end of the second portion 113 may extend downward further than the lower end of the first portion 112. In detail, the front surface of the second portion 113 extending downward from the rear end of the bottom of the first portion 112 may be defined as a door contact surface 114. Like the front surface of the housing 15, the door contact surface 114 prevents the entrance refrigerator 10 from being separated from the front door 1 or the wall by the moment.

A contact shoulder 115 may be formed at a point spaced apart rearward from the front end of the cabinet 11 by a predetermined distance.

The contact shoulder 115 may protrude from the inner circumferential surface of the cabinet 11 by a predetermined height, and may have a rectangular band shape extending along the inner circumferential surface of the cabinet 11.

A rectangular opening defined along the inner edge of the contact shoulder 115 may define an inlet portion for goods entering or exiting the storage compartment 111.

A space between the front end of the cabinet 11 and a front surface of the contact shoulder 115 may be defined as an outdoor side door accommodation portion into which the outdoor side door 12 is received.

In a state in which the outdoor side door 12 is closed, the outer gasket 21 is in close contact with the front surface of the contact shoulder 115 to prevent leakage of cold air from the storage compartment 111.

The longitudinal cross-section of the storage compartment 111 defined at the rear of the contact shoulder 115 may have the same size as the longitudinal cross-section of the inlet portion. That is, the bottom surface of the storage compartment 111 may be coplanar with the upper edge of the contact shoulder 115 extending from the inner circumferential surface of the bottom portion of the cabinet 11. The bottom surface of the storage compartment 111 may include the base plate 20.

In addition, the left and right side surfaces of the storage compartment 111 may be coplanar with the inner edges of the contact shoulder 115 extending from the left inner circumferential surface and the right inner circumferential surface of the cabinet 11, respectively.

Finally, the ceiling surface of the storage compartment 111 may be coplanar with the lower edge of the contact shoulder 115 extending from the inner circumferential surface of the upper end of the cabinet 11.

In summary, it can be understood that the inner circumferential surface of the storage compartment 111 is coplanar with the inner edges of the contact shoulder 115.

However, the present disclosure is not limited to the above configuration. For example, the bottom surface of the storage compartment 111 may be coplanar with the bottom surface of the outdoor side door accommodation portion.

In detail, the contact shoulder 115 may be described as including a lower shoulder 115*a*, a left shoulder 115*b*, a right shoulder (see FIG. 6), and an upper shoulder 115*c*, and the bottom surface (floor) of the storage compartment 111 may be designed to be lower than the upper edge of the lower shoulder 115*a*.

In addition, the left and right side surfaces of the storage compartment 111 may be designed to be wider than the inner edges of the left shoulder 115*b* and the right shoulder.

Finally, the upper surface (ceiling) of the storage compartment 111 may be designed to be higher than the lower edge of the upper shoulder 115*c*.

According to this structure, the width and height of the storage compartment 111 may be formed to be larger than the width and height of the inlet portion.

A slot 116 may be formed at the bottom of the cabinet corresponding to the bottom of the outdoor side door accommodation portion.

The point where the slot 116 is formed may be described as a point spaced a predetermined distance rearward from the front end of the cabinet 11, or a point spaced a predetermined distance forward from the front surface of the contact shoulder 115.

The slot 116 may be formed at a position closer to the contact shoulder 115 than to the front end of the cabinet 11. As the air that has a relatively high temperature and is discharged from the housing 15 rises, the air may be introduced into the outdoor side door accommodation portion of the cabinet 11 through the slot 116.

The air flowing through the slot 116 flows along the edge of the outer gasket 21 to evaporate any condensation that may form on the outer gasket 21.

In detail, an inwardly stepped portion 119 may be formed in the bottom surface of the cabinet 11 corresponding to the first portion 112 and in the front surface of the cabinet 11 corresponding to the second portion 113. The stepped portion 119 is enclosed by the guide plate 18, and an air flow passage 119*a* is formed between the guide plate 18 and the stepped portion 119. The lower end of the air flow passage 119*a* communicates with the inside of the housing 15, and the upper end of the air flow passage 119*a* is connected to the slot 116.

Due to this structure, the relatively high-temperature air discharged from the housing 15 moves along the air flow passage 119*a* and flows into the slot 116.

A mount plate seating portion 117 may be formed at a predetermined depth on the inner bottom surface of the cabinet 11, particularly on the bottom surface of the cabinet 11 corresponding to the second portion 113.

A cold air suction hole 118 may be formed on the bottom of the mount plate seating portion 117. The mount plate 24 is mounted on the mount plate seating portion 117 such that the through-hole 242 and the cold air suction hole 118 are aligned in the vertical direction.

In addition, the flow guide 23 is disposed above the mount plate seating portion 117, particularly on the upper surface of the mount plate 24.

Figure 13:
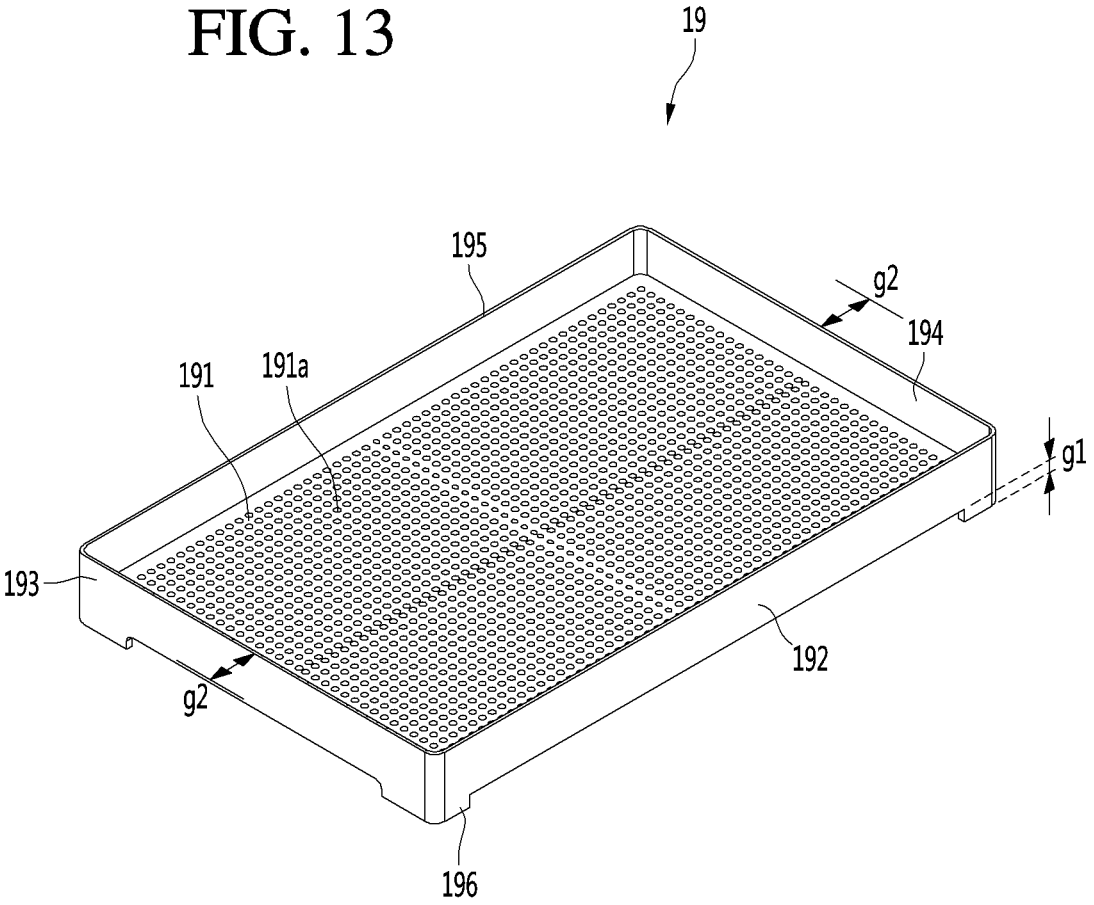
FIG. 13 is a perspective view of a tray accommodated in a storage compartment of the entrance refrigerator, according to an embodiment.

FIG. 13 is a perspective view of the tray 19 accommodated in the storage compartment 111 of the entrance refrigerator 10, according to an embodiment.

Referring to FIG. 13, the tray 19 according to the embodiment may include a rectangular bottom portion 191, an edge wall surrounding the edge of the bottom portion 191 and extending to a predetermined height, and legs 196 extending downward from four corners of the bottom portion 191.

A plurality of through-holes 191*a* may be formed in the bottom portion 191.

The edge wall may include a front portion 192, a left side portion 193, a right side portion 194, and a rear side portion 195.

The bottom portion 191 is spaced apart from the bottom of the storage compartment 111 by the legs 196 to form a lower gap g1.

The height of the lower gap g1 corresponds to the height of the legs 196, and the width of the lower gap g1 corresponds to the distance between two adjacent legs.

In addition, the left-to-right width of the bottom portion 191 is formed to be smaller than the left-to-right width of the storage compartment 111, such that the edge wall of the tray 19 and the sidewall of the storage compartment 111 are separated by a predetermined distance to form a side gap g2. The front-to-rear width of the bottom portion 191 may also be formed to be smaller than the front-to-rear width of the storage compartment 111 to form a side gap.

The side gap g2 may be about 5 mm, but the dimension of the gap g2 is not limited thereto.

Figure 14:
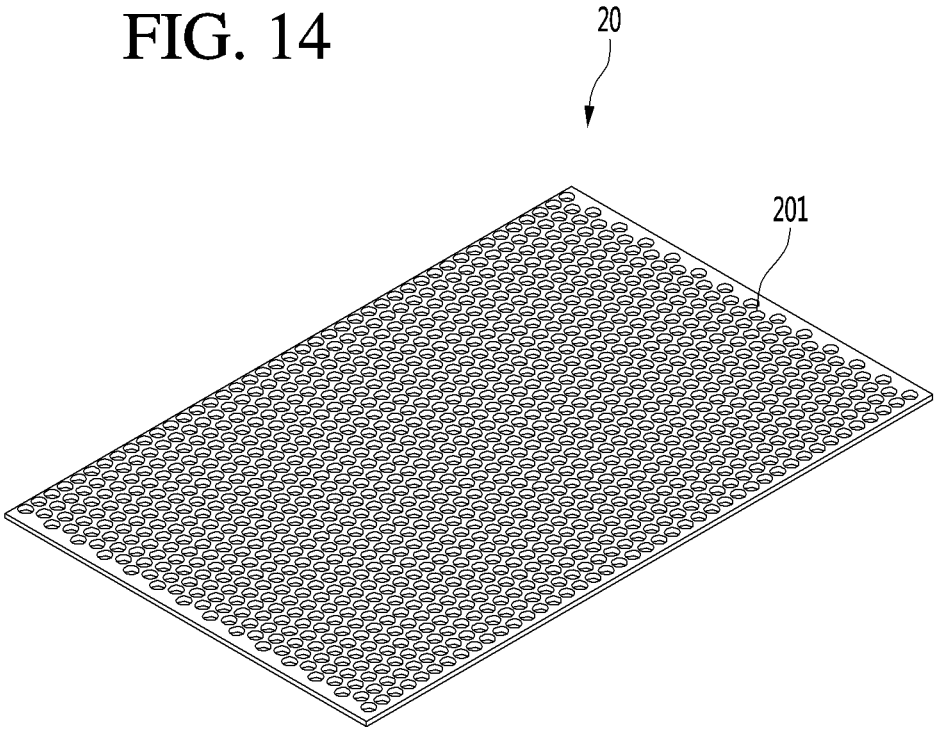
FIG. 14 is a perspective view of a base plate disposed on the bottom of the storage compartment of the entrance refrigerator, according to an embodiment.

FIG. 14 is a perspective view of the base plate 20 disposed on the bottom of the storage compartment 111 of the entrance refrigerator 10, according to an embodiment.

Referring to FIG. 14, the base plate 20 according to the embodiment may be formed to be the same size as the bottom portion 191 of the tray 19. Alternatively, the base plate 20 may be formed to be the same size as the bottom portion of the storage compartment 111.

A plurality of through-holes 201 may be formed in the base plate 20, and the plurality of through-holes 201 may include circular holes or polygonal holes.

Referring to FIGS. 9 to 11, the base plate 20 may be spaced apart from the bottom surface of the storage compartment 111 by a predetermined interval.

The separation distance between the base plate 20 and the bottom surface of the storage compartment 111 is set to a dimension in consideration of the height of the lower shoulder 115*a*, so that the upper surface of the base plate 20 and the lower shoulder 115*a* may form the same plane.

According to this configuration, when the user or the delivery person withdraws the tray 19 from the storage compartment 111 or inserts the tray 19 into the storage compartment 111, the lower shoulder 115*a* does not act as an obstacle that prevents the tray 19 from being inserted or withdrawn.

That is, there is an advantage that the tray 19 can be pulled out by sliding the tray 19 on the base plate 20.

In addition, since the separation space is formed between the base plate 20 and the bottom surface of the storage compartment 111, the cold air guided by the flow guide 23 is evenly distributed throughout the lower portion of the storage compartment 111.

The separation distance between the base plate 20 and the bottom surface of the storage compartment 111 may be about 15 mm, but the separation distance is not limited thereto.

Figure 15:
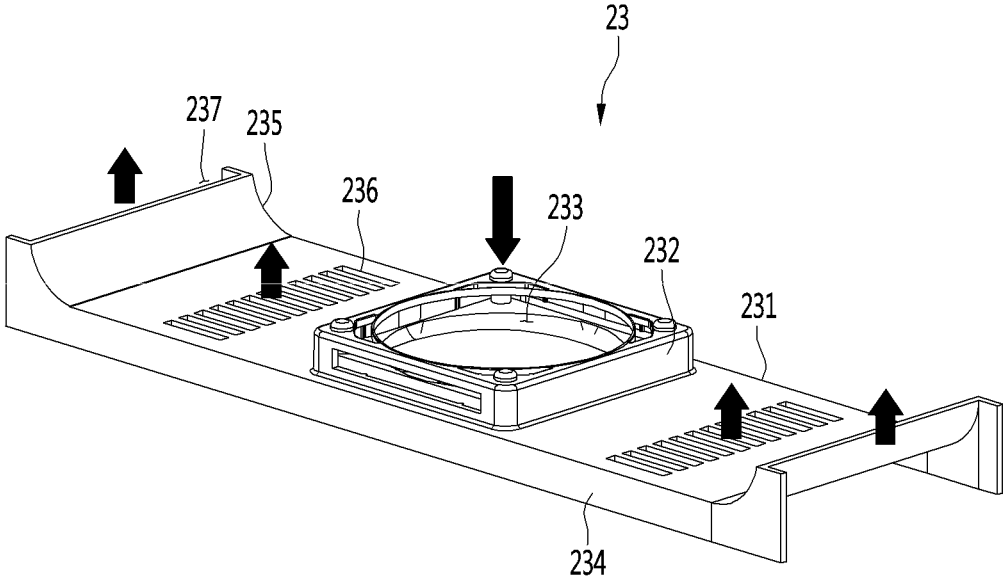
FIG. 15 is a perspective view of a flow guide disposed on the bottom of the entrance refrigerator, according to an embodiment.

FIG. 15 is a perspective view of the flow guide 23 disposed on the bottom of the entrance refrigerator 10, according to an embodiment.

Referring to FIG. 15, the flow guide 23 according to the embodiment may include a bottom portion 231, curved portions 235 extending upward from the left and right edges of the bottom portion 231 in a rounded form, extension ends 234 extending downward from the front end and the rear end of the bottom portion 231 and the curved portions 235, and a fan housing 232 protruding upward from the center of the upper surface of the bottom portion 231.

The extension ends 234 may include a front extension end extending downward from the front end of the bottom portion 231 and the front ends of the curved portions 235, and a rear extension end extending downward from the rear end of the bottom portion 231 and the rear ends of the curved portions 235.

The ends of the curved portions 235 and the extension ends 234 define side discharge ports at the left and right edges of the flow guide 23, respectively.

In addition, main discharge ports 236 may be formed at points spaced apart from the fan housing 232 to the left and the right of the fan housing 232 by a predetermined distance. The main discharge ports 236 may be formed by a plurality of slits that extend a predetermined length in the left-to-right direction of the flow guide 23 and are spaced apart in the front-to-rear direction of the flow guide 23. However, the main discharge ports 236 may also be provided in the form of one or more openings elongated in the front-to-rear direction of the flow guide 23.

The fan housing 232 may protrude a predetermined height from the bottom portion 231 so as to accommodate the heat absorption fan 33. A suction port 233 may be formed in the upper surface of the fan housing 232.

Due to this structure, when the heat absorption fan 33 is rotated, cold air inside the storage compartment 111 is guided toward the cold sink 32 through the suction port 233. The cold air cooled while passing through the cold sink 32 flows in the horizontal direction of the flow guide 23. The cold air flowing in the horizontal direction of the flow guide 23 forms a circulation flow path discharged into the storage compartment 111 through the main discharge ports 236 and the side discharge ports 237.

Meanwhile, the left end and the right end of the flow guide 23 are in close contact with the left edge and the right edge of the mount plate seating portion 117. As a result, the side discharge ports 237 are formed on the upper surface of the flow guide 23, such that the cold air is discharged upward toward the ceiling of the storage compartment 111.

Figure 16:
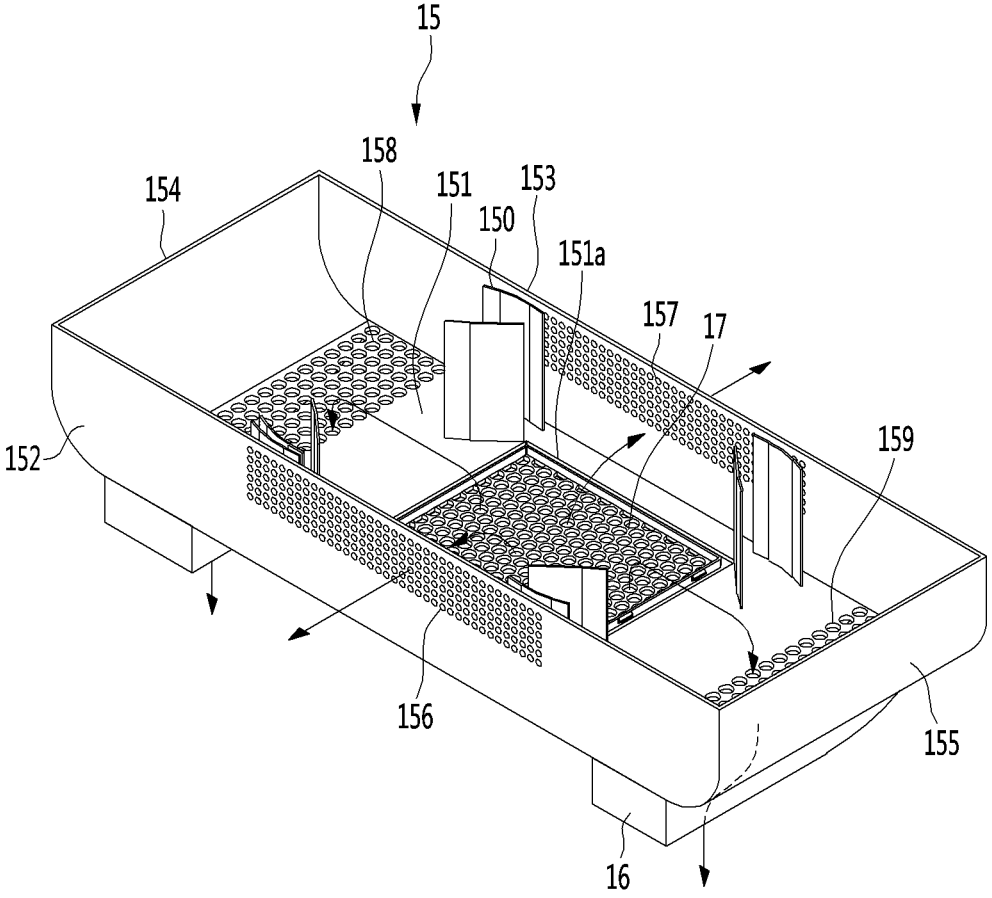
FIG. 16 is a perspective view showing the internal structure of a housing of the entrance refrigerator, according to an embodiment.

FIG. 16 is a perspective view showing the internal structure of the housing 15 constituting the entrance refrigerator 10, according to an embodiment.

Referring to FIG. 16, the housing 15 according to the embodiment is coupled to the lower end of the cabinet 11, specifically the lower end of the cabinet 11 defined as the second portion 113.

One portion of the cold air supply device 30 is accommodated in the housing 15, and another portion of the cold air supply device 30 is accommodated in the lower space of the cabinet 11 corresponding to the second portion 113.

In one example, the heat absorption fan 33, the cold sink 32, and the thermoelectric element 31 may be accommodated in the lower space of the second portion 113 of the cabinet 11, and the heat sink 34 and the heat dissipation fan 36 may be accommodated in the housing 15. However, this arrangement may be changed according to design conditions.

The housing 15 may include a bottom portion 151, a front surface portion 152 extending upward from the front end of the bottom portion 151, a rear surface portion 153 extending upward from the rear end of the bottom portion 151, a left surface portion 154 extending upward from the left end of the bottom portion 151, and a right surface portion 155 extending upward from the right end of the bottom portion 151.

A pair of guide ducts 16 are mounted on the bottom surface of the bottom portion 151.

A suction hole 151*a* is formed at the center of the bottom portion 151, and a suction plate 17 is mounted over the suction hole 151*a*.

A left discharge port 158 and a right discharge port 159 are formed on the left edge and the right edge of the bottom portion 151, respectively. The left discharge port 158 and the right discharge port 159 may be composed of an assembly of circular or polygonal holes. However, the present disclosure is not limited thereto, and each of the left discharge port 158 and the right discharge port 159 may have a rectangular hole shape having a predetermined width and length.

The guide ducts 16 are mounted directly below the left discharge port 158 and the right discharge port 159, respectively.

One or more flow guide plates 150 may be disposed on the upper surface of the bottom portion 151 corresponding to four corner portions of the suction hole 151*a*. In detail, a plurality of flow guide plates 150 may be disposed at the four corner portions of the suction hole 151*a*. A portion of outside air introduced into the housing 15 through the suction plate 17 that exchanges heat with the heat sink 34 may be guided to the left discharge port 158 and the right discharge port 159 by the flow guide plate 150.

A front discharge port 156 and a rear discharge port 157 may be formed at the centers of the front surface portion 152 and the rear surface portion 153, respectively. A portion of the outside air introduced through the suction plate 17 may exchange heat with the heat sink 34 and may be discharged to the outside through the front discharge port 156 and the rear discharge port 157.

The front discharge port 156 and the rear discharge port 157 may also be defined as an assembly of a plurality of holes, but the present disclosure is not limited thereto. However, since the discharge ports 156, 157, 158 and 159 are composed of a plurality of holes having a small diameter, it is possible to minimize the introduction of foreign substances into the housing 15.

The guide plate 18 may be coupled to the cabinet 11 as an independent member, or may be a part of the housing 15 extending upward from the upper end of the front surface portion 152 and bent forward.

The left surface portion 154 and the right surface portion 155 may extend upward from the left and right edges of the bottom portion 151 in a rounded form.

Figure 17:
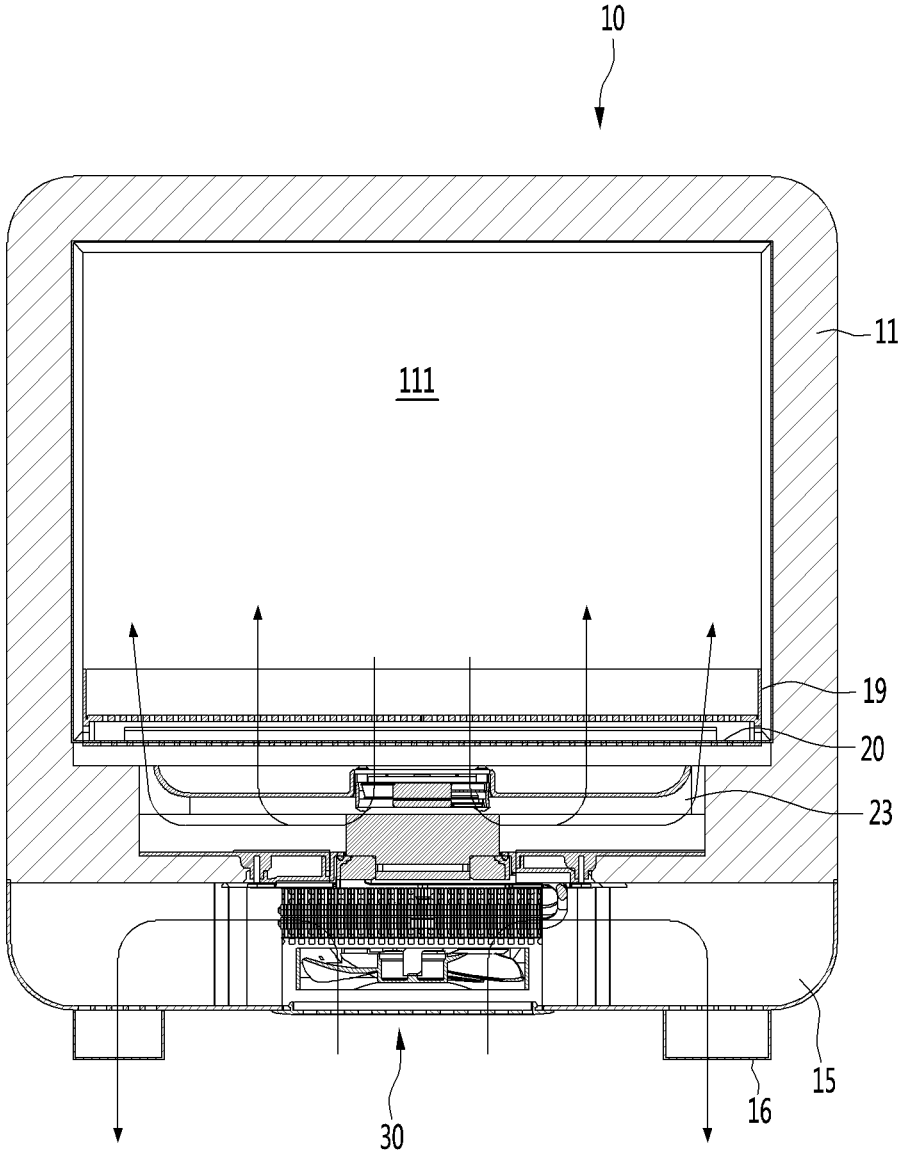
FIG. 17 is a view showing the circulation of cold air inside the storage compartment in a state in which goods are absent from the tray.
Figure 18:
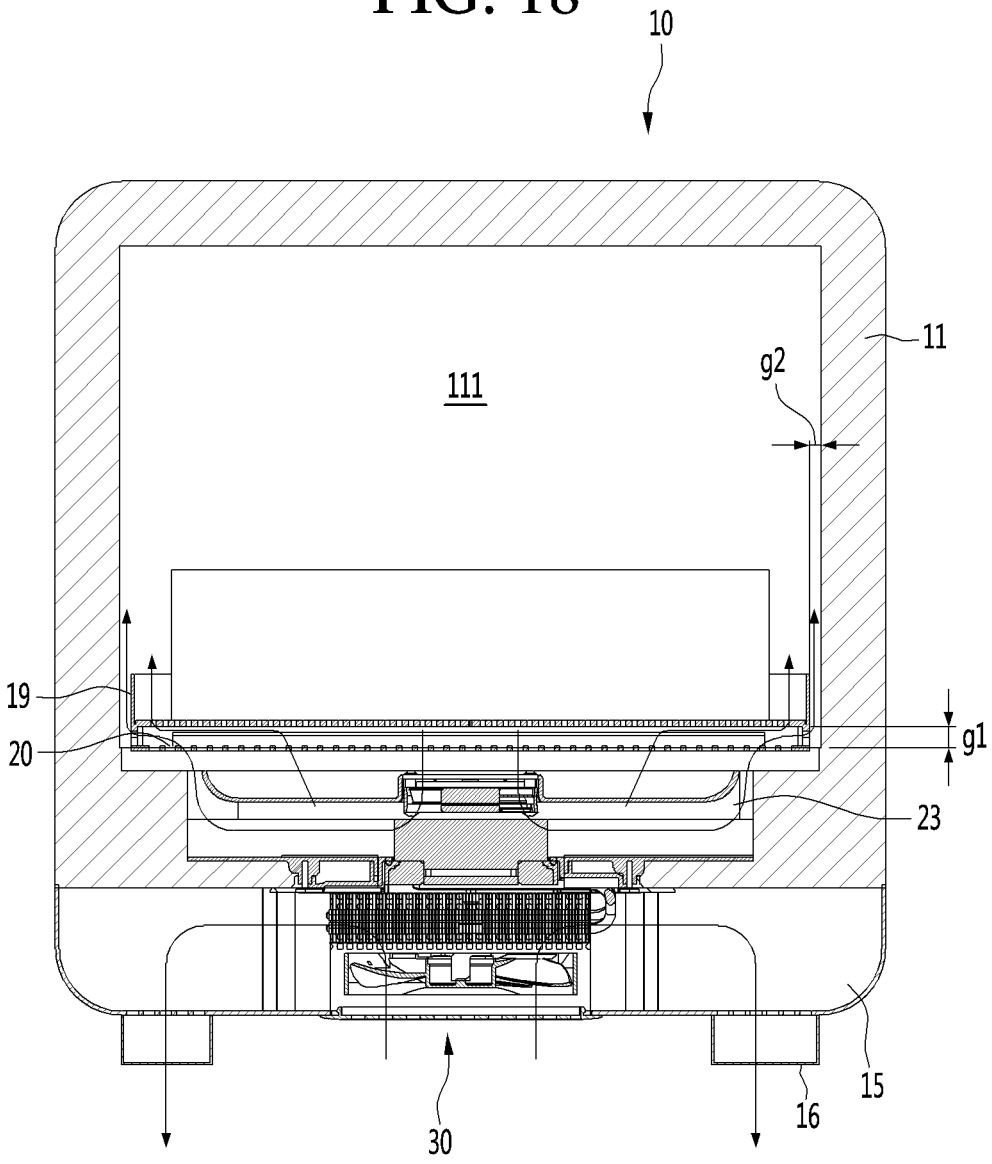
FIG. 18 is a view showing the circulation of cold air inside the storage compartment in a state in which goods are placed in the tray.

FIG. 17 is a view showing the circulation of cold air inside the storage compartment 111 in a state in which goods are absent from the tray 19, and FIG. 18 is a view showing the circulation of cold air inside the storage compartment 111 in a state in which goods are placed on the tray 19.

First, air circulation by the cold air supply device 30 will be described.

An example will be described where a constant voltage is applied to the thermoelectric element 31 such that the upper surface acts as the heat absorbing surface and the lower surface acts as the heat generating surface, and the storage compartment 111 is kept in a refrigerating or freezing state.

When a voltage is applied to the thermoelectric element 31, the temperature of the cold sink 32 attached to the heat absorbing surface of the thermoelectric element 31 is lowered, and the temperature of the heat sink 34 attached to the heat generating surface of the thermoelectric element 31 is raised.

When the heat absorption fan 33 rotates, air inside the storage compartment 111 is guided to the cold sink 32 through the heat absorption fan 33. The air guided to the cold sink 32 exchanges heat with the cold sink 32 to lower the temperature of the air.

The air whose temperature is lowered flows in the left and right edge directions of the storage compartment 111 along the cold air flow path formed between the flow guide 23 and the mount plate 24.

The air flowing to the left and right sides of the storage compartment 111 along the flow guide 23 flows into the storage compartment 111 through the main discharge port 236 and the side discharge port 237 formed in the flow guide 23.

The cold air discharged to the storage compartment 111 through the main discharge ports 236 and the side discharge ports 237 passes through the base plate 20 and the bottom portion of the tray 19 and rises to the ceiling of the storage compartment 111. The air rising to the ceiling of the storage compartment 111 descends again to form a circulation flow path that returns back to the heat absorption fan 33.

Meanwhile, when the heat dissipation fan 36 rotates, the air outside of the entrance refrigerator 10, that is, the air of the indoor side (I), is introduced into the housing 15 through the suction plate 17.

The indoor air introduced into the housing 15 exchanges heat with the heat sink 34 to increase the temperature of the air. That is, the heat is absorbed from the heat sink 34 to increase the temperature of the air. The indoor air whose temperature has risen is discharged in the front-to-rear direction and the horizontal direction of the entrance refrigerator 10 through the discharge ports 156, 157, 158 and 159.

A portion of the air flowing toward the front discharge port 156 is guided to the slot 116 along the air flow passage 119*a* shown in FIG. 12.

The air guided to the left discharge port 158 and the right discharge port 159 flows forward of the housing 15 along the guide duct 16 and is then discharged to the outside of the housing 15 through the discharge ports 161. Since the discharge ports 161 are disposed close to the rear surface of the front door 1 or the wall in which the entrance refrigerator 10 is mounted, that is, the surface exposed to the inside, the air discharged to the discharge ports 161 may form a flow path that descends along the rear surface of the front door 1 or the wall.

Referring to FIG. 17, when there are no goods stored in the storage compartment 111 and thus the tray 19 is empty, the air guided through the cold sink 32 toward the storage compartment 111 rises vertically through the base plate 20 and the bottom portion 191 of the tray 19.

Referring to FIG. 18, when a large amount of goods or bulky goods are put in the tray 19, the air guided toward the storage compartment 111 encounters flow resistance caused by the goods located in the tray.

The air that encounters the flow resistance is dispersed horizontally in all directions and flows toward the edges of the tray 19 along the bottom surfaces of the goods. The cold air flowing toward the edges of the tray 19 passes through the lower gap g1 formed by the legs 196 of the tray 19. The cold air passing through the lower gap g1 rises through the side gap g2 formed between the four side edges of the tray 19 and the four side surfaces of the storage compartment 111.

As such, since the bottom portion 191 of the tray 19 is spaced apart from the bottom of the storage compartment 111 by the length of the legs 196 and the lower gap g1 is formed, it is possible to prevent a blockage of the discharge flow path of the cold air guided to the storage compartment 111 by the flow guide 23.

Furthermore, since the side gap g2 is formed between the horizontal edge of the tray 19 and the inner wall of the storage compartment 111, the cold air flowing below the stored goods can flow to the upper side of the storage compartment 111 without hovering only on the lower side of the tray 19.

Figure 19:
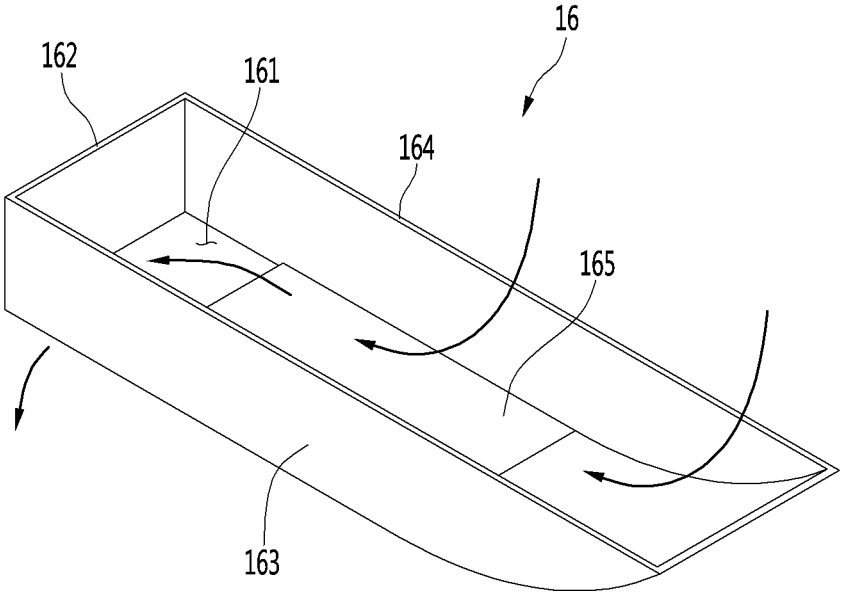
FIG. 19 is a perspective view of a guide duct of the entrance refrigerator according to an embodiment.
Figure 20:
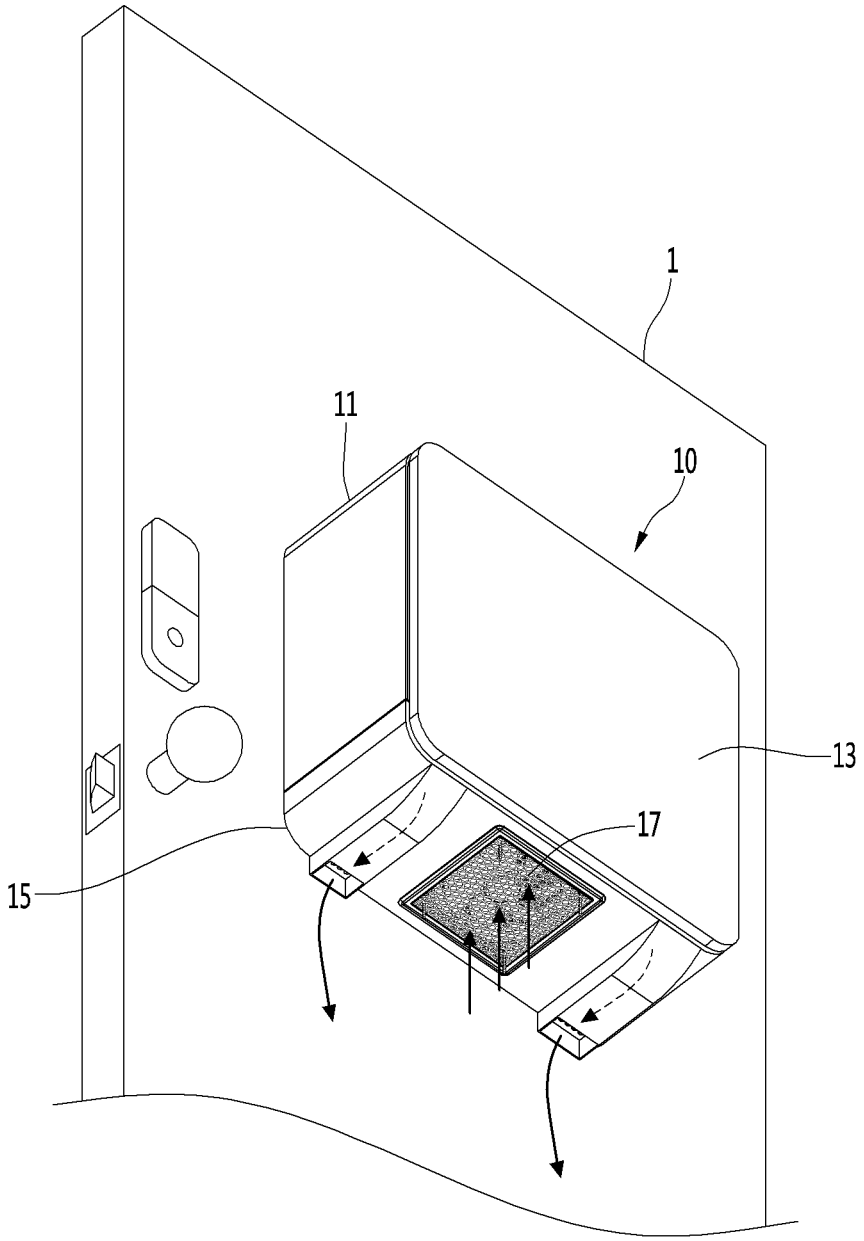
FIG. 20 is a view illustrating a flow state of indoor air discharged through the guide duct when the entrance refrigerator according to the embodiment is mounted on a front door.

FIG. 19 is a perspective view of the guide duct 16 of the entrance refrigerator 10 according to an embodiment, and FIG. 20 is a view illustrating a flow state of indoor air discharged through the guide duct 16 when the entrance refrigerator 10 according to the embodiment is mounted on a front door 1.

Referring to FIG. 19, the guide duct 16 of the entrance refrigerator 10 is configured to be mounted on the bottom surface of the housing 15.

As illustrated in FIG. 16, a left discharge port 158 and a right discharge port 159 may be formed near the left and right edges, respectively, of the bottom portion 151 of the housing 15.

The guide duct 16 may be mounted on the left edge and the right edge of the bottom surface of the housing 15 corresponding to the locations of the left discharge port 158 and the right discharge port 159, respectively.

Therefore, indoor air, which is suctioned through the suction plate 17, exchanges heat with the heat sink 34 to increase the temperature of the air, and is then discharged through the left discharge port 158 and the right discharge port 159, is guided to the guide ducts 16 and discharged back into the room.

Each guide duct 16 may include a front portion 162, a left side portion 163, a right side portion 164, and a bottom portion 165.

The opened upper surface of each guide duct 16 is enclosed by attaching the guide duct 16 to the bottom surface of the housing 15.

The front portion 162 comes in close contact with the rear surface of the front door 1 or wall on which the entrance refrigerator 10 is mounted. However, even if the front portion 162 is not provided, the rear surface of the front door 1 or wall may still perform its function.

The bottom portion 165 extends rearward from a point spaced apart from the front portion 162 (or the rear surface of the front door) by a predetermined distance to the rear side to thereby define the discharge port 161 between the front portion 162 and the front end of the bottom portion 165.

The bottom portion 165 may include a horizontal extension portion and a rounded portion. That is, a distance from the front end of the bottom portion 165 to the rear side may be extended horizontally. The rear end of the horizontal extension portion may extend to the rear end of the bottom portion 165 and be rounded upward.

As such, since the portion corresponding to the opposite end of the discharge port 161 is rounded, the indoor air may be discharged to the discharge port 161 while minimizing the flow resistance of the indoor air flowing through the left discharge port 158 and the right discharge port 159 of the housing 15.

Referring to FIG. 20, when the heat dissipation fan 36 is driven, indoor air is suctioned into the housing 15 through the suction plate 17. The indoor air suctioned into the housing 15 exchanges heat with the heat sink 34 to increase the temperature of the air.

The indoor air, whose temperature has increased, is dispersed in the front-to-rear and left-to-right horizontal directions of the housing 15. The air dispersed in the horizontal directions of the housing 15 moves downward into the guide ducts 16 through the left discharge port 158 and the right discharge port 159.

The indoor air moving downward to the guide ducts 16 flows toward the front end of each guide duct 16 and is discharged to the indoor space through the discharge ports 161.

The indoor air, which is discharged to the discharge port 161 while flowing from the rear end to the front end of the guide duct 16, hits the rear surface of the front door 1 or wall by flow inertia and then moves downward toward the floor.

The indoor air moving downward along the rear surface of the front door 1 or wall may drop in temperature while exchanging heat with the front door 1 or wall.

In general, since the front door 1 may be made of a steel plate, the temperature of the front door 1 is typically the same as the indoor temperature or less. Therefore, the indoor air discharged at a relatively high temperature loses heat to the front door 1 while moving downward along the front door 1.

In addition, since the indoor air discharged through the discharge port 161 moves downward along the rear surface of the front door 1, it is unlikely that the indoor air discharged with a temperature higher than the indoor temperature will directly touch the body or face of the user standing in front of the front door 1.

In addition, since the high-temperature air discharged through the rear discharge port 157 of the housing 15 hits the indoor side door 13 and flows to the floor of the entrance, the air discharged through the rear discharge port 157 also does not directly hit the user.

In addition, since the indoor air discharged through the front discharge port 156 of the housing 15 also hits the rear surface of the front door 1 or wall and flows to the floor of the entrance, the air does not directly hit the user.

In addition, the indoor air discharged through the front discharge port 156 loses heat to the front door 1 or wall while moving downward along the rear surface of the front door 1 or wall.

The above-disclosed subject matter is to be considered illustrative, and not restrictive, and the appended claims are intended to cover all such modifications, enhancements, and other embodiments, which fall within the true spirit and scope of the present disclosure.

Thus, the technical spirit of the present disclosure is not limited to the foregoing embodiment.

Therefore, the scope of the present disclosure is defined not by the detailed description of the invention but by the appended claims, and all differences within the scope will be construed as being included in the present disclosure.

What is claimed is:

1. An entrance refrigerator, comprising:

a cabinet configured to extend through an entrance door or a wall, the cabinet including a storage compartment therein for storing goods;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier being located in a space defined by the housing and the lower side of the cabinet; and at least one guide duct located at a bottom side of the housing, the at least one guide duct extending in a front-to-rear direction of the housing, the at least one guide duct having a guide duct discharge port located therein, wherein the at least one guide duct comprises:

a bottom portion in which the guide duct discharge port is located;

a left side portion extending upward from a left edge of the bottom portion; and a right side portion extending upward from a right edge of the bottom portion.

2. The entrance refrigerator according to claim 1, wherein the at least one guide duct comprises:

a left guide duct located at a left edge of the bottom side of the housing; and a right guide duct located at a right edge of the bottom side of the housing.

3. The entrance refrigerator according to claim 1, wherein the guide duct discharge port is located in a front end of the bottom portion, and wherein front ends of the left side portion and the right side portion of the at least one guide duct are configured to be located in close proximity to the entrance door or the wall.

4. The entrance refrigerator according to claim 3, wherein a portion of the bottom portion spaced rearward of the guide duct discharge port by a predetermined distance is rounded upward toward a rear end of the at least one guide duct.

5. The entrance refrigerator according to claim 1, wherein the housing includes a front discharge port provided in a front portion of the housing, the front discharge port being configured to face a rear surface of the entrance door or the wall.

6. The entrance refrigerator according to claim 1, wherein the housing includes a rear discharge port provided in a rear portion of the housing, the rear discharge port being covered by the indoor side door.

7. The entrance refrigerator according to claim 1, wherein the housing includes:

a suction hole provided in a bottom portion of the housing; and a suction plate located at the suction hole, the suction plate including a plurality of through-holes provided therein through which indoor air is suctioned.

8. The entrance refrigerator according to claim 7, wherein the cold air supplier comprises:

a thermoelectric element having a heat absorbing surface and a heat generating surface;

a cold sink in contact with the heat absorbing surface;

a heat absorption fan disposed above the cold sink;

a heat sink in contact with the heat generating surface; and a heat dissipation fan disposed below the heat sink, wherein, when the heat dissipation fan is driven, indoor air is introduced into the housing through the suction plate, and wherein the indoor air introduced into the housing is discharged out of the housing through the guide duct discharge port in a state in which a temperature of the indoor air is increased through heat exchange with the heat sink.

9. The entrance refrigerator according to claim 8, wherein the cold air supplier further comprises an insulation material located between the cold sink and the heat sink to reduce heat transfer between the heat sink and the cold sink.

10. The entrance refrigerator according to claim 1, wherein the housing includes:

a front discharge port provided in a front portion of the housing, the front discharge port being configured to face a rear surface of the entrance door or the wall;

a rear discharge port provided in a rear portion of the housing, the rear discharge port being covered by the indoor side door; and a bottom discharge port provided in a bottom portion of the housing, the bottom discharge port being configured to discharge air from the housing and into the at least one guide duct.

11. The entrance refrigerator according to claim 10, wherein the at least one guide duct comprises:

a left guide duct located at a left edge of the bottom side of the housing; and a right guide duct located at a right edge of the bottom side of the housing, and wherein the housing further includes:

a suction hole provided in the bottom portion of the housing and located between the left guide duct and the right guide duct; and a suction plate located at the suction hole, the suction plate including a plurality of through-holes provided therein through which indoor air is suctioned.

12. The entrance refrigerator according to claim 11, wherein the left guide duct and the right guide duct each include a bottom wall portion in which the guide duct discharge port is located, the guide duct discharge port being located in a front end of the bottom wall portion, and wherein front ends of the left guide duct and the right guide duct are configured to be located in close proximity to the entrance door or the wall, so that air discharged from the guide duct discharge port is directed downwardly along the entrance door or the wall.

13. An entrance refrigerator, comprising:

a cabinet configured to extend through a door or a wall, the cabinet including a storage compartment therein for storing goods;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier being located in a space defined by the housing and the lower side of the cabinet; and at least one guide duct located at a bottom side of the housing, the at least one guide duct extending in a front-to-rear direction of the housing, the at least one guide duct having a guide duct discharge port located therein, wherein the housing includes:

a suction hole provided in a bottom portion of the housing; and a suction plate located at the suction hole, the suction plate including a plurality of through-holes provided therein through which indoor air is suctioned, and wherein the housing further includes a bottom discharge port provided in the bottom portion of the housing, the bottom discharge port being configured to discharge air from the housing and into the at least one guide duct.

14. A refrigerator, comprising:

a cabinet configured to be located partially within a barrier of a building, the cabinet including a storage compartment therein, the cabinet having a first opening into the storage compartment and a second opening into the storage compartment, the second opening being spaced from the first opening;

a housing located at a lower side of the cabinet;

a first door coupled to the cabinet to open or close the first opening;

a second door coupled to the cabinet to open or close the second opening;

a cold air supplier configured to supply cold air to the storage compartment, at least a portion of the cold air supplier being located within the housing; and at least one guide duct located at a bottom side of the housing, the at least one guide duct extending in a front-to-rear direction of the housing, the at least one guide duct having a guide duct discharge port located therein, wherein the at least one guide duct includes a bottom wall portion in which the guide duct discharge port is located, the guide duct discharge port being located in a first end of the bottom wall portion, and wherein a first end of the at least one guide duct is configured to be located in close proximity to the barrier, so that air discharged from the guide duct discharge port is directed downwardly along the barrier.

15. The refrigerator according to claim 14, wherein the housing includes:

a first discharge port provided in a first portion of the housing, the first discharge port being configured to face a surface of the barrier;

a second discharge port provided in a second portion of the housing, the second discharge port being covered by the second door; and a third discharge port provided in a bottom portion of the housing, the third discharge port being configured to discharge air from the housing and into the at least one guide duct.

16. The refrigerator according to claim 14, wherein the housing includes:

a suction hole provided in a bottom portion of the housing; and a suction plate located at the suction hole, the suction plate including a plurality of through-holes provided therein through which air is suctioned.

17. The refrigerator according to claim 16, wherein the at least one guide duct comprises:

a first guide duct located at a first edge of the bottom side of the housing; and a second guide duct located at a second edge of the bottom side of the housing, and wherein the suction plate is located between the first guide duct and the second guide duct.

18. The refrigerator according to claim 16, wherein the cold air supplier comprises:

a thermoelectric element having a heat absorbing surface and a heat generating surface;

a cold sink in contact with the heat absorbing surface;

a heat absorption fan disposed above the cold sink;

a heat sink in contact with the heat generating surface; and a heat dissipation fan disposed below the heat sink, wherein, when the heat dissipation fan is driven, air is introduced into the housing through the suction plate, and wherein the air introduced into the housing is discharged out of the housing through the guide duct discharge port in a state in which a temperature of the air is increased through heat exchange with the heat sink.

* * * * *